US009295886B2

(12) United States Patent
Stokke et al.

(10) Patent No.: US 9,295,886 B2
(45) **Date of Patent: *Mar. 29, 2016**

(54) GOLF CLUB HEADS WITH RIBS AND RELATED METHODS

(71) Applicant: KARSTEN MANUFACTURING CORPORATION, Phoenix, AZ (US)

(72) Inventors: Ryan M. Stokke, Phoenix, AZ (US); Martin R. Jertson, Phoenix, AZ (US); Eric V. Cole, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 123 days.

This patent is subject to a terminal disclaimer.

(21) Appl. No.: 14/012,546

(22) Filed: Aug. 28, 2013

(65) Prior Publication Data

US 2014/0011607 A1 Jan. 9, 2014

Related U.S. Application Data

(63) Continuation of application No. 13/768,624, filed on Feb. 15, 2013, and a continuation-in-part of application No. 13/196,488, filed on Aug. 2, 2011, now Pat. No. 8,523,704, which is a continuation-in-part of application No. 12/541,817, filed on Aug. 14, 2009, now Pat. No. 8,206,242, which is a continuation-in-part of application No. 12/430,821, filed on Apr. 27, 2009, now Pat. No. 7,874,935, which is a continuation of application No. 12/047,957, filed on Mar. 13, 2008, now Pat. No. 7,563,177, which is a continuation of application No. 11/496,216, filed on Jul. 31, 2006, now Pat. No. 7,396,298.

(60) Provisional application No. 61/737,716, filed on Dec. 14, 2012.

(51) Int. Cl.
*A63B 53/04* (2015.01)

(52) U.S. Cl.
CPC ..... *A63B 53/0466* (2013.01); *A63B 53/04* (2013.01); *A63B 53/047* (2013.01); *A63B 53/0487* (2013.01); *A63B 2053/045* (2013.01); *A63B 2053/0433* (2013.01); *A63B 2053/0437* (2013.01); *A63B 2053/0441* (2013.01); *Y10T 29/49826* (2015.01)

(58) Field of Classification Search
USPC ..... 473/324–350
See application file for complete search history.

(56) References Cited

U.S. PATENT DOCUMENTS

| | | | |
|---|---|---|---|
| 4,214,754 | A | 7/1980 | Zebelean |
| 4,432,549 | A | 2/1984 | Zebelean |
| 4,681,321 | A | 7/1987 | Chen et al. |
| 5,067,715 | A | 11/1991 | Schmidt et al. |
| 5,180,166 | A | 1/1993 | Schmidt et al. |
| 5,213,328 | A | 5/1993 | Long et al. |
| 5,351,958 | A | 10/1994 | Helmstetter |
| 5,419,559 | A | 5/1995 | Melanson et al. |

(Continued)

FOREIGN PATENT DOCUMENTS

| | | | |
|---|---|---|---|
| CA | 2 471 397 | A1 | 12/2005 |
| CN | 2636914 | Y | 9/2004 |

(Continued)

*Primary Examiner* — Alvin Hunter

(57) ABSTRACT

Golf club heads with ribs are described herein. Other embodiments and related methods are also disclosed herein.

19 Claims, 12 Drawing Sheets

(56) References Cited

U.S. PATENT DOCUMENTS

| | | | | |
|---|---|---|---|---|
| 6,059,669 | A | 5/2000 | Pearce | |
| 6,595,871 | B2 | 7/2003 | Sano | |
| 6,645,087 | B2 | 11/2003 | Yabu | |
| 6,783,465 | B2 | 8/2004 | Matsunaga | |
| 6,852,038 | B2 | 2/2005 | Yabu | |
| 7,250,007 | B2 | 7/2007 | Lu | |
| 7,273,423 | B2 | 9/2007 | Imamoto | |
| 7,396,298 | B2 | 7/2008 | Jertson et al. | |
| 7,448,961 | B2 * | 11/2008 | Lin | 473/332 |
| 7,507,168 | B2 | 3/2009 | Chou et al. | |
| 7,563,177 | B2 | 7/2009 | Jertson et al. | |
| 7,749,104 | B2 | 7/2010 | Brekke et al. | |
| 7,806,781 | B2 | 10/2010 | Imamoto | |
| 7,828,676 | B2 | 11/2010 | Wada et al. | |
| 7,874,935 | B2 | 1/2011 | Jertson et al. | |
| 7,887,433 | B2 | 2/2011 | Hoffman et al. | |
| 8,206,242 | B2 | 6/2012 | Jertson et al. | |
| 8,414,421 | B2 | 4/2013 | Jertson et al. | |
| 8,425,347 | B2 | 4/2013 | Jertson et al. | |
| 8,523,704 | B2 | 9/2013 | Jertson et al. | |
| 2002/0065147 | A1 | 5/2002 | Sano | |
| 2002/0072434 | A1 | 6/2002 | Yabu | |
| 2003/0104878 | A1 | 6/2003 | Yabu | |
| 2003/0114244 | A1 | 6/2003 | Matsunaga | |
| 2004/0266551 | A1 | 12/2004 | Noguchi et al. | |
| 2005/0049081 | A1 | 3/2005 | Boone | |
| 2005/0221913 | A1 | 10/2005 | Kusumoto | |
| 2006/0052181 | A1 | 3/2006 | Serrano et al. | |
| 2008/0070721 | A1 | 3/2008 | Chen et al. | |
| 2010/0029408 | A1 | 2/2010 | Abe | |
| 2013/0157777 | A1 | 6/2013 | Stokke et al. | |

FOREIGN PATENT DOCUMENTS

| | | | |
|---|---|---|---|
| EP | 1 757 335 | A1 | 2/2007 |
| GB | 2417909 | | 3/2006 |
| GB | 2440511 | A | 2/2008 |
| JP | 04327864 | A | 11/1992 |
| JP | 09154984 | A | 6/1997 |
| JP | 2001095957 | A | 4/2001 |
| JP | 2001353240 | A | 12/2001 |
| JP | 2002126136 | A | 5/2002 |
| JP | 2002239641 | A | 8/2002 |
| JP | 2003159354 | A | 6/2003 |
| JP | 2005073736 | A | 3/2005 |
| JP | 2005137788 | A | 6/2005 |
| JP | 2005237948 | A | 9/2005 |
| JP | 2005287529 | A | 10/2005 |
| JP | 2005312942 | A | 11/2005 |

* cited by examiner

1600

GOLF CLUB HEADS WITH RIBS AND RELATED METHODS

CLAIM OF PRIORITY

This application is a continuation of U.S. patent application Ser. No. 13/768,624, filed on Feb. 15, 2013, which claims priority to U.S. Provisional Patent Application No. 61/737,716, filed on Dec. 14, 2012, and which is a continuation-in-part of U.S. patent application Ser. No. 13/196,488, filed on Aug. 2, 2011, which is a continuation-in-part of U.S. patent application Ser. No. 12/541,817, filed on Aug. 14, 2009, now U.S. Pat. No. 8,206,242, which is a continuation-in-part of U.S. patent application Ser. No. 12/430,821, filed on Apr. 27, 2009, now U.S. Pat. No. 7,874,935, which is a continuation of U.S. patent application Ser. No. 12/047,957, filed on Mar. 13, 2008, now U.S. Pat. No. 7,563,177, which is a continuation of U.S. patent application Ser. No. 11/496,216, filed on Jul. 31, 2006, now U.S. Pat. No. 7,396,298. The contents of the disclosures listed above are incorporated herein by reference.

TECHNICAL FIELD

The present invention generally relates to golf equipment and, more particularly, to golf club heads.

BACKGROUND

Modern wood-type golf club heads are now almost exclusively made of metal rather than the persimmon wood that gave the clubs their name. These club heads are generally constructed as a hollow metal shell with a relatively thick face to withstand the ball impact and a relatively thick sole to withstand grazing impact with the ground as well as lowering the center of gravity of the club head. The remainder of the club head is manufactured as thin as possible so as to allow the maximum amount of material to be dedicated to the face and sole portions. Although the crown and skirt of a modern club head are quite thin, they still must be sufficiently rigid in the direction of the maximum stress in order to provide support for the face of the club head.

Ribs have commonly been employed in the crowns of club heads to enable the crowns to be as lightweight as possible while still providing sufficient stiffness in the fore and aft direction. U.S. Pat. No. 4,214,754 to Zebelean discloses a hollow club head with a crown that includes parallel ribs running perpendicular to the face of the club head that extend internally and bridge the thin transition with the crown. Similarly, U.S. Pat. No. 6,595,871 to Sano discloses a hollow club head with a separately attached face and a crown that includes a plurality of parallel ribs extending perpendicular to the face. U.S. Pat. No. 5,067,715 to Schmidt et al discloses a hollow club head that includes a crown with a plurality of parallel ribs that merge into and run perpendicularly to the club head face as well as a plurality of ribs that merge into and run perpendicularly to a rear wall of the club head.

The prior art fails to recognize that a club head having a crown with parallel ribs that uniformly reinforce the face of the club head is not an efficient structure since the club head face is not uniformly loaded but is subjected to essentially a point impact near its center.

DESCRIPTION

Figure 1:
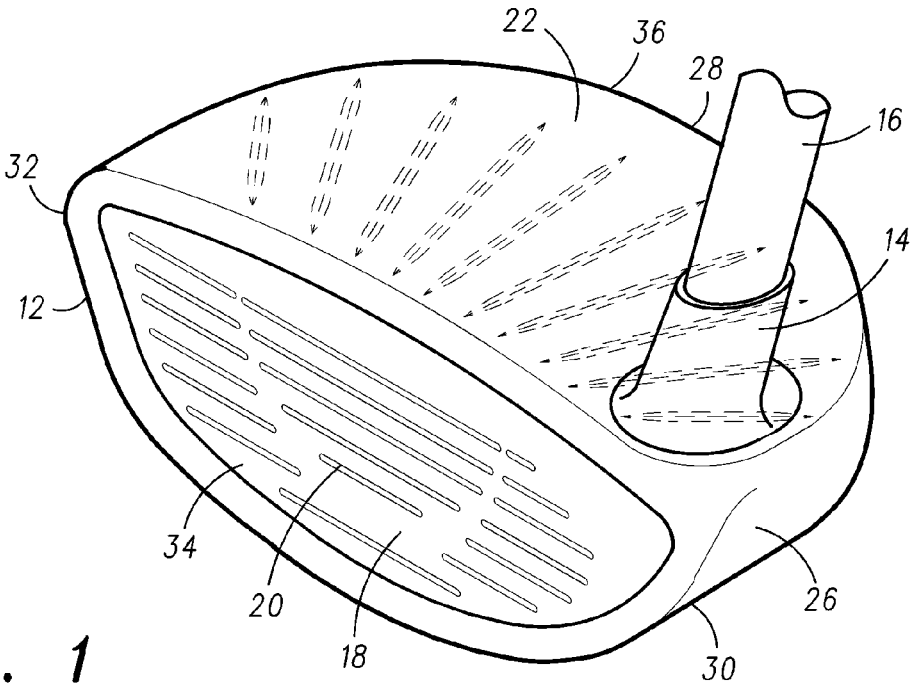
FIG. 1 is a front perspective view of a golf club head incorporating features of the present invention.

In a first example, a golf club head can comprise a body and a plurality of ribs protruded from a rib surface of the body. The body can comprise having a heel end, a toe end, a sole, a front surface, and a rear surface. The plurality of ribs can comprise a first rib with a first longitudinal axis, a second rib with a second longitudinal axis, a third rib with a third longitudinal axis. The first, second, and third longitudinal axes can intersect at a common point external to the body.

In a second example, a golf club head can comprise a body and a plurality of ribs protruded from a rib surface of the body. The body can comprise a heel end, a toe end, a crown, a sole, a front surface, and a rear surface. The plurality of ribs can be generally straight and non-intersecting, and/or may comprise a first rib closest to the heel end of the body and a second rib closest to the toe end of the body. The plurality of ribs also may be arranged in a substantially radial pattern to form a fan-like shape between the first and second ribs.

In a third example, a method can comprise (a) providing a body of a golf club head with a heel end, a toe end, a sole, a front surface, and a rear surface, and (b) providing a plurality of ribs protruded from a rib surface of the body. The plurality of ribs can comprise a first rib with a first longitudinal axis extending through a common point, a second rib with a second longitudinal axis extending through the common point, and a third rib with a third longitudinal axis extending through the common point, wherein the common point can be external to the body.

In one embodiment, a golf club head comprises a body having a heel end, a toe end, a sole, and a front surface, and a plurality of ribs protruded from a rib surface of the body. The plurality of ribs comprise (a) a first rib comprising a first-first rib end, a first-second rib end opposite the first-first rib end, and a first axis extending through the first-first rib end and the first-second rib end; (b) a second rib comprising a second-first rib end, a second-second rib end opposite the second-first rib end and a second axis extending through the second-first rib end and the second-second rib end, and (c) a third rib comprising a third-first rib end, a third-second rib end opposite the third-first rib end, and a third axis extending through the third-first rib end and the third-second rib end. The front surface comprises a strikeface with a strikeface centerpoint, and a loft plane tangent to the strikeface centerpoint defines a front plane of the golf club head. The first rib can be located between the second and third ribs. The first axis can comprise a first distance between the front plane and the first-first rib end. The second axis can comprise a second distance between the front plane and the second-first rib end. The third axis can comprise a third distance between the front plane and the third-first rib end. At least one of the first, second, or third distances can be greater than at least another one of the first, second, or third distances.

In one embodiment, a golf club head can comprise a body having a heel end, a toe end, a sole, and a front surface, and a plurality of ribs protruded from a rib surface of the body. The plurality of ribs can comprise (a) a first rib comprising a first-first rib end, a first-second rib end opposite the first-first rib end, and a first axis extending through the first-first rib end and the first-second rib end; (b) a second rib comprising a second-first rib end, a second-second rib end opposite the second-first rib end, and a second axis extending through the second-first rib end and the second-second rib end; and (c) a third rib comprising a third-first rib end, a third-second rib end opposite the third-first rib end, and a third axis extending through the third-first rib end and the third-second rib end. The first rib can be located between the second and third ribs. The first axis can comprise a first distance between the front surface and the first-first rib end. The second axis can comprise a second distance between the front surface and the second-first rib end. The third axis can comprise a third distance between the front surface and the third-first rib end. At least one of the first, second, or third distances can be greater than at least another one of the first, second, or third distances.

In one example, a method for providing a golf club head can comprise providing a body having a heel end, a toe end, a sole, and a front surface, and providing a plurality of ribs protruded from a rib surface of the body. Providing the plurality of ribs can comprise (a) providing a first rib comprising a first-first rib end, a first-second rib end opposite the first-first rib end, and a first axis extending through the first-first rib end and the first-second rib end; (b) providing a second rib comprising a second-first rib end, a second-second rib end opposite the second-first rib end, and a second axis extending through the second-first rib end and the second-second rib end; and (c) providing a third rib comprising a third-first rib end, a third-second rib end opposite the third-first rib end, and a third axis extending through the third-first rib end and the third-second rib end. Providing the body can comprise coupling a strikeface at the front surface, the strikeface comprising a strikeface centerpoint. A loft plane of the golf club head can be tangent to the strikeface centerpoint. When the golf club head is at address over a ground flat surface, the loft plane intersects the ground flat surface along a front intersection line, and a front plane extends orthogonal to the ground flat surface from the front intersection line. The first rib can be located between the second and third ribs. The first axis can comprise a first distance between the first-first rib end and a front reference comprising one of the loft plane, the front plane, or the front surface. The second axis can comprise a second distance between the second-first rib end and the front reference. The third axis can comprise a third distance between the third-first rib end and the front reference. The plurality of ribs are staggered relative to the front reference such that at least one of the first, second, or third distances can be greater than at least another one of the first, second, or third distances.

Other examples and embodiments are further disclosed herein. Such examples and embodiments may be found in the figures, in the claims, and/or in the present description.

Figure 3:
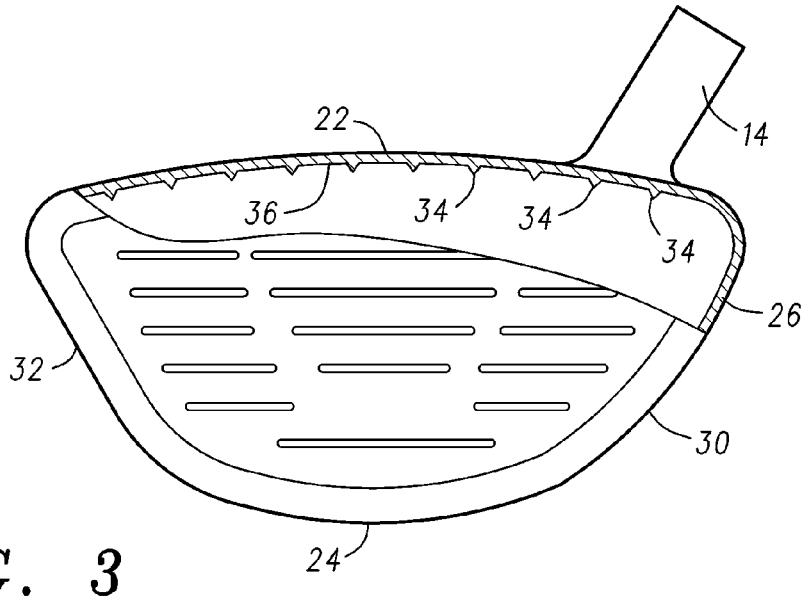
FIG. 3 is a partial cross-sectional view of the club head of FIG. 1 viewed from the front.
Figure 2:
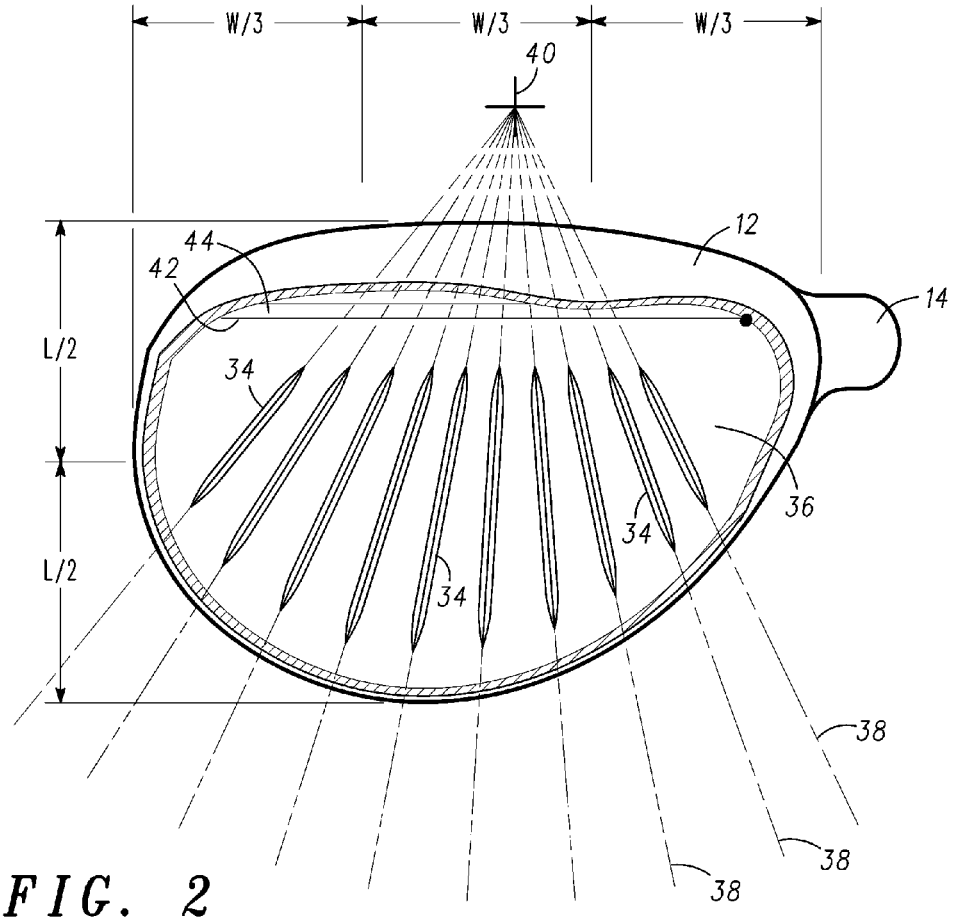
FIG. 2 is a cross-sectional view of the club head of FIG. 1 viewed from below.

With reference to FIGS. 1-3, golf club 10 comprises a club head 12, a hosel 14 and a shaft 16. Club head 12 is composed of a hollow body 18, typically made of stainless steel, titanium or other material having a high shear modulus of elasticity and high strength-to-weight ratio. Hollow body 18 comprises a front wall or face 20 adapted for impacting a golf ball. Hollow body 18 further comprises a top wall or crown 22, a bottom wall or sole 24, and a side wall or skirt 26 that connects the face 20 to crown 22 and sole 24. Club head 12 further includes a heel end 30 and a toe end 32. Skirt 26 wraps around the club head 12 between the heel and toe ends 30, 32 to form a rear wall 28. Golf club head 12 can be a golf club head for a driver type club, a fairway wood, or a hybrid club.

Crown 22 comprises a thin walled structure preferably cast as part of hollow body 18. Crown 22 is preferably titanium having a relatively thin thickness dimension of 0.076 centimeters (cm)±0.013 cm. Crown 22 is reinforced with a plurality of ribs 34 extending downward from lower surface 36 of crown 22. Each rib 34 extends from a first end proximal, but spaced from, the front wall 20 to a second end proximal, but spaced from, the rear wall 28. The ribs 34 are spaced apart by a greater amount, preferably 20 percent greater, at their second ends than at their first ends. Adjacent ribs 34 diverge from their first ends toward their second ends by an angle of at least 5 degrees. Ribs 34 comprise narrow, elongate, generally straight, metallic, shock wave distributing elements with a height dimension of 0.051 cm.±0.013 cm and width dimension of 0.178 cm±0.013 cm. Ribs 34 are generally convex downward when viewed in cross-section and blend smoothly into lower surface 36 of crown 22. It will be understood that crown 22 is free of ribs extending transversely between the ribs 34.

The lower surface 36 of the crown 22 has a forward portion and a rearward portion as defined by a midline lying generally parallel to the front wall 20 one-half the distance between a forwardmost point on the front wall 20 and a rearwardmost point on the rear wall 28. The first ends of the ribs 34 terminate in the forward portion of the crown 22 and the second ends of the ribs 34 terminate in the rearward portion of the crown 22.

As shown most clearly in FIG. 2, ribs 34 are arrayed in a pattern such that the longitudinal axes 38 of the ribs 34 radiate from and intersect at a point 40 in space located forward of front wall 20. Point 40 is preferably located within the middle one third (W/3) of the width of front wall 20 and is preferably located substantially in front of the center line of front wall 20. Note that because club head 12 is a three dimensional body, as used herein, point 40 refers to a single point when viewed in plan view as in FIG. 2. Alternatively, point 40 can be thought of as a vertical line consisting of the locus of intersections of vertical planes passing through the center lines of the ribs 34.

Ribs 34 originate at a first location proximal the intersection 42 of the rear surface 44 of front wall 20 and lower surface 36 of crown 22 and extend to a second location proximal rear wall 28. In the illustrative embodiment, at least half, and preferably all of the ribs 34 extend from front wall 20 past the mid-point (L/2) of club head 12 and are not interconnected by any transverse ribs. Accordingly, each rib 34 acts independently of the other ribs 34 interconnected only by the intervening thin section of crown 22 therebetween. Preferably, point 40 is also no more than L/2 forward of front wall 20. This results in a pattern of ten ribs 34 subtending an angle of approximately 60 degrees or an angular divergence of from 4 to 8 degrees, preferably about 6 degrees of divergence between adjacent ribs 34.

The surprising result of this arrangement of ribs 34 is that although an array of perpendicular ribs 0.051 cm high by 0.178 cm wide results in only a 9% reduction in maximum stress as compared with unreinforced crown region, ribs 34 arranged in a radial fan pattern in accordance with the present invention reduce maximum stress in the crown region by almost 36%. Although not wishing to be held to any particular theory of operation, it is believed that because the face 20 itself deforms non-uniformly extending outward from the point of impact, the loads are transferred to the crown region in a similar non-uniform manner radiating outward from the point of impact. Therefore, arranging the ribs 34 in a radial pattern extending out from near the point of impact yields a crown 22 that more efficiently supports the face 20 during impact.

In addition to straight linear ribs with substantially constant widths and heights as demonstrated in the example of FIGS. 1-3, it is possible to have alternate embodiments of a golf club head with ribs. For example, the ribs can be curved or the heights and/or widths of the ribs can be varied.

Figure 4:
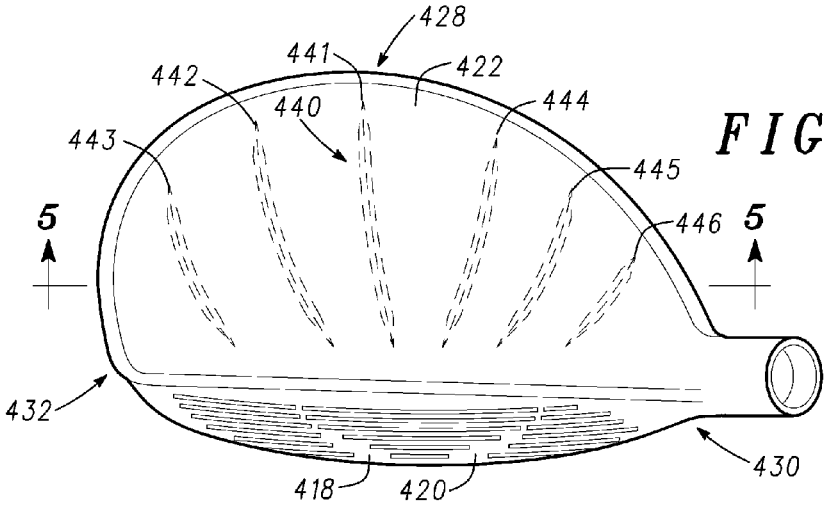
FIG. 4 is a top view of a golf club head, according to a second embodiment.
Figure 5:
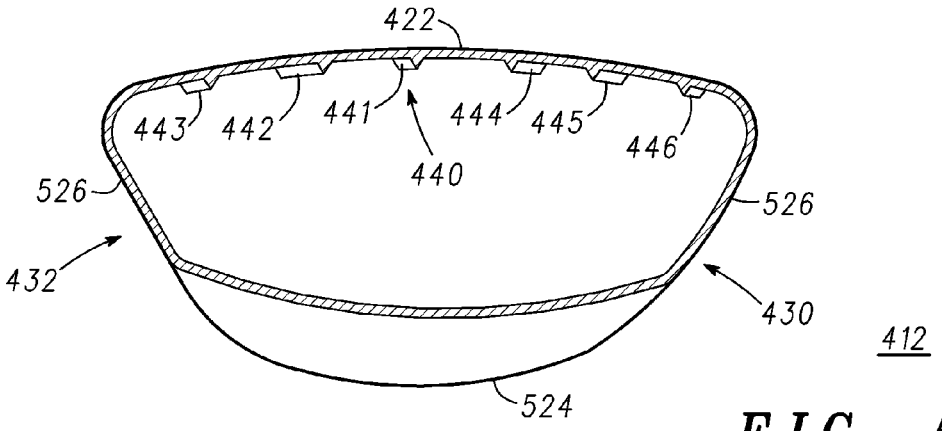
FIG. 5 is a full cross-sectional view of the club head of FIG. 4 viewed from the front.

As an example, FIG. 4 illustrates another embodiment of a golf club head. FIG. 5 illustrates a cross-sectional view of the embodiment of FIG. 4 taken at the lines labeled "5." Golf club head 412 (FIG. 4) includes a hollow body 418 (FIG. 4) with a front wall 420 (FIG. 4), a crown 422 (FIG. 4), a sole 524 (FIG. 5), a side wall 526 (FIG. 5) connecting crown 422 and sole 524, a heel end 430 (FIG. 4), a toe end 432 (FIG. 4), and a rear side 428 (FIG. 4) that is opposite of front wall 420. In addition, golf club head 412 can also include ribs 440 (FIG. 4) that extend downwardly from the lower surface of crown 422. In the example of the embodiment illustrated in FIG. 4, ribs 440 comprise ribs 441, 442, 443, 444, 445, and 446 that have a first end that is proximal to front wall 420 and a second end that is proximal to rear side 428.

In some examples, one or more of ribs 440 can be curved. As an example, each of ribs 441, 442, 443, 444, 445, and 446 are curved in the example of FIG. 4. In other examples, however, some of ribs 440 may not be curved. For example, rib 441 can be linear. When ribs 440 are curved, the length of ribs 440 can be increased. A longer rib allows for more of the rib to absorb the vibration.

Each of ribs 440 of FIG. 4 are curved. In some examples, ribs 440 can be curved in different directions. For example, ribs 441, 442, and 443 can be curved in one direction, while ribs 444, 445, and 446 can be curved in the opposite direction. Ribs 441, 442, and 443 are curved convexly with respect to toe end 432. Therefore, the first end and second end of ribs 441, 442, and 443 are curved away from toe 432 end towards heel end 430. On the other hand, ribs 444, 445, and 446 are curved convexly with respect to heel end 430. Therefore, the first end and second end of ribs 444, 445, and 446 are curved away from heel end 430 towards toe end 432. In one example, at least two of ribs 440 would intersect if extended forwardly in a linear or curved fashion toward front wall 420. For example, the linear extension of rib 442 would intersect with the linear extension of rib 444 near front wall 420 or, in a different embodiment, in front of front wall 420. It should be noted that there may be alternate curve arrangements for ribs 440. For example, more ribs of ribs 440 may curve towards one direction than the other, or all the ribs may curve in the same direction. In addition, there may be less or more than six ribs 440.

Each of ribs 440 can have a radius of curvature. A radius of curvature is the radius of the circle that is created by an extrapolation of the rib. In some examples, each of ribs 440 has a different radius of curvature. In other examples, some of the radii can be approximately equal to each other.

In the example of golf club head 412 illustrated in FIG. 4, rib 441 has the largest radius of curvature. The radius of curvature of the subsequent ribs decreases the closer the rib is to heel end 430 or toe end 432 relative to rib 441. For example, the radius of curvature of rib 442 is less than that of rib 441, and the radius of curvature of rib 443 is less than that of rib 442. Furthermore, the radius of curvature of rib 444 is less than that of rib 441; the radius of curvature of rib 445 is less than that of rib 444; and the radius of curvature of rib 446 is less than that of rib 445. In other examples the radii of curvature of ribs 440 can increase the closer the rib is to heel end 430 or toe end 432 relative to rib 441. In yet other examples, the radii of curvature of ribs 440 can have no relation to the rib's position relative to rib 441.

In the same or other examples, the radii of curvature for the ribs can be symmetric with each other according to their position relative to rib 441. For example, the radius of curvature of rib 442 can be approximately equal to the radius of curvature of rib 444, and the radius of curvature of rib 443 can be approximately equal to the radius of curvature of rib 445. In other examples, the radii of curvature for ribs 440 are asymmetric with each other.

Each of ribs 440 has a width dimension. In the example of FIG. 4, each of ribs 440 has a width that is approximately equal to the other ribs. In other examples, ribs 440 can have widths that are not equal to every other rib. In some examples, each of ribs 440 has a tapering first end and a tapering second end. In other examples, there is no tapering of the first end and/or the second end.

In addition, each of ribs 440 has a height dimension. The height dimension is a measure of the distance that a rib extends from crown 422 into hollow body 418. In the example of FIG. 5, each of ribs 440 has a height that is approximately equal to the heights of each of the other ribs. In other examples, ribs 440 can have heights that are not equal to the other ribs.

Each of ribs 440 has a length dimension also. The length dimension is a measure of the (curved) distance between a rib's first end and its second end. In the example of FIG. 4, the ribs towards the midpoint between toe end 432 and heel end 430 have the greatest length. In addition, the length of a rib decreases the closer the rib is to toe end 432 or heel end 430. As an example, rib 441 has the greatest length; the length of rib 442 is greater than that of rib 443; the length of rib 444 is greater than that of rib 445; and the length of rib 445 is greater than that of rib 446. In other examples, all of ribs 440 have an approximately equal length.

Figure 6:
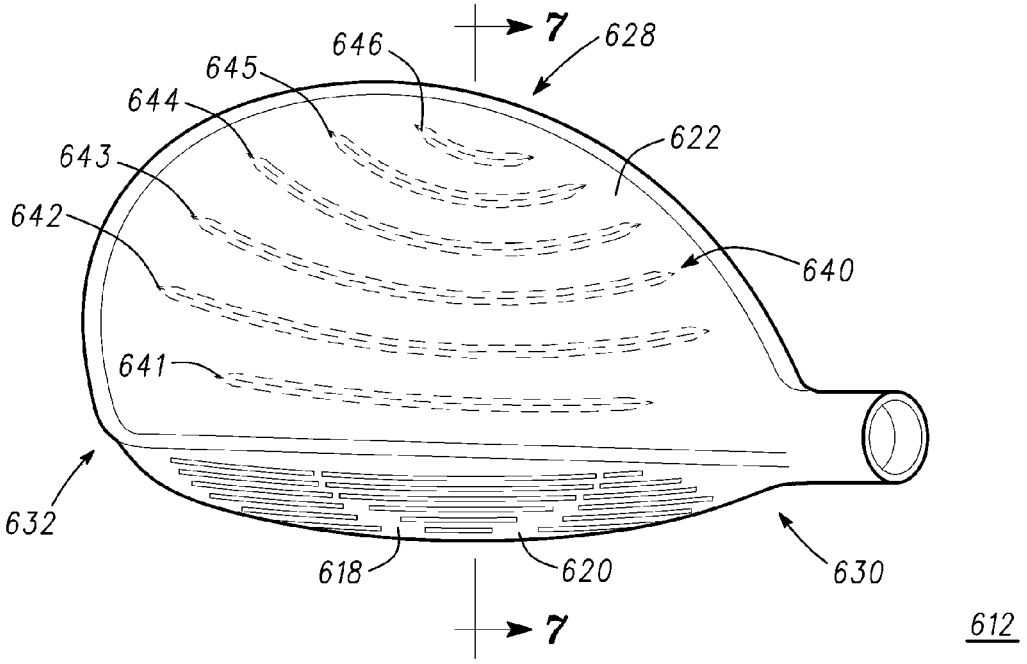
FIG. 6. is a top view of a golf club head, according to a third embodiment.
Figure 7:
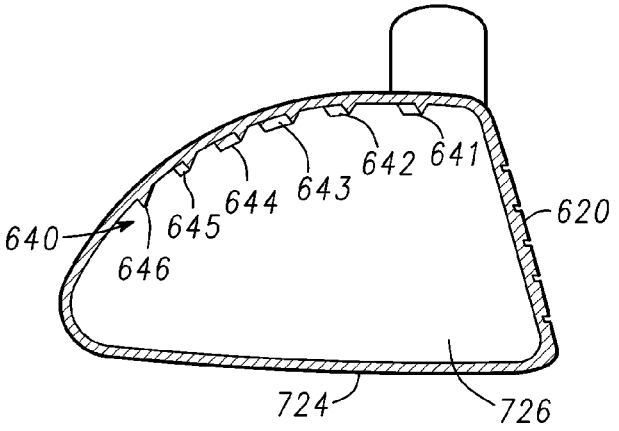
FIG. 7 is a full cross-sectional view of the club head of FIG. 6 viewed from the side.

FIG. 6 illustrates another embodiment of a golf club head. FIG. 7 illustrates a cross-sectional view of the embodiment of FIG. 6 taken at the lines labeled "7." Golf club head 612 (FIG. 6) includes a hollow body 618 (FIG. 6) with a front wall 620 (FIG. 6), a crown 622 (FIG. 6), a sole 724 (FIG. 7), a side wall 726 (FIG. 7) connecting crown 622 and sole 624, a heel end 630 (FIG. 6), a toe end 632 (FIG. 6), and a rear side 628 (FIG. 6). In addition, golf club head 612 can also include ribs 640 (FIG. 6) that extend downwardly from the lower surface of crown 622. In the example of the embodiment illustrated in FIG. 6, ribs 640 comprise ribs 641, 642, 643, 644, 645, and 646 that have a first end that is proximal to toe end 632 and a second end that is proximal to heel end 630.

In some examples, one or more of ribs 640 can be curved. As an example, each of ribs 641, 642, 643, 644, 645, and 646 are curved in the example of FIG. 6. In other examples, however, some of ribs 640 may not be curved. For example, rib 641 can be linear.

Each of ribs 640 of FIG. 6 are curved. In some examples, ribs 640 are all curved in the same direction. For example, ribs 641, 642, 643, 644, 645, and 646 are curved convexly with respect to front wall 620. Therefore, the first end and second end of ribs 640 are curved away from front wall 620. It should be noted that there may be alternate curve arrangements for ribs 640. For example, if the dimensions of golf club head 612 decrease significantly at rear side 628 relative to front wall 620, some of ribs 640 may be curved concavely with respect to front wall 602. In other embodiments, some of ribs 640 may have a first end that is proximal to front wall 620 and a second end that is proximal to rear side 628. In addition, there may be less or more than six ribs 440.

Each of ribs 640 can have a radius of curvature. In some examples, each of ribs 640 has a different radius of curvature. In other examples, some of the radii of curvature can be approximately equal to each other.

In the example of golf club head 612 illustrated in FIG. 6, rib 641 has the largest radius of curvature. The radius of curvature of the subsequent ribs decreases the closer the rib is to rear end 628. For example, the radius of curvature of rib 642 is less than that of rib 641; the radius of curvature of rib 643 is less than that of rib 642; the radius of curvature of rib 644 is less than that of rib 643; the radius of curvature of rib 645 is less than that of rib 644; and the radius of curvature of rib 646 is less than that of rib 645. In other examples, the radii of curvature of ribs 640 can increase for each rib that is closer to rear 628. In yet other examples, the radii of curvature of ribs 640 have no relation to the rib's position relative to rear end 628.

Each of ribs 640 has a width dimension. In the example of FIG. 6, each of ribs 640 has a width that is approximately equal to the other ribs. In other examples, ribs 640 can have widths that are not equal to the other ribs. In some examples, each of ribs 640 has a tapering first end and a tapering second end. In other examples, there is no tapering of the first end and/or the second end.

In addition, each of ribs 640 has a height dimension. The height dimension is a measure of the distance that a rib extends from crown 622 into hollow body 618. In the example of FIG. 7, each of ribs 640 have a height that is approximately equal to the heights of each of the other ribs. In other examples, ribs 640 can have heights that are not equal to the other ribs.

Each of ribs 640 has a length dimension also. The length dimension is a measure of the (curved) distance between a rib's first end and its second end. In the example of FIG. 6, the ribs closer to front wall 620 generally have a greater length than the ribs closer to rear side 628. As an example, the length of rib 642 is greater than that of rib 643; the length of rib 643 is greater than that of rib 644; the length of rib 644 is greater than that of rib 645; and the length of rib 645 is greater than that of rib 646. The length of rib 642, however, is greater than that of rib 641. In other examples, all of ribs 640 have an approximately equal length.

Figure 8:
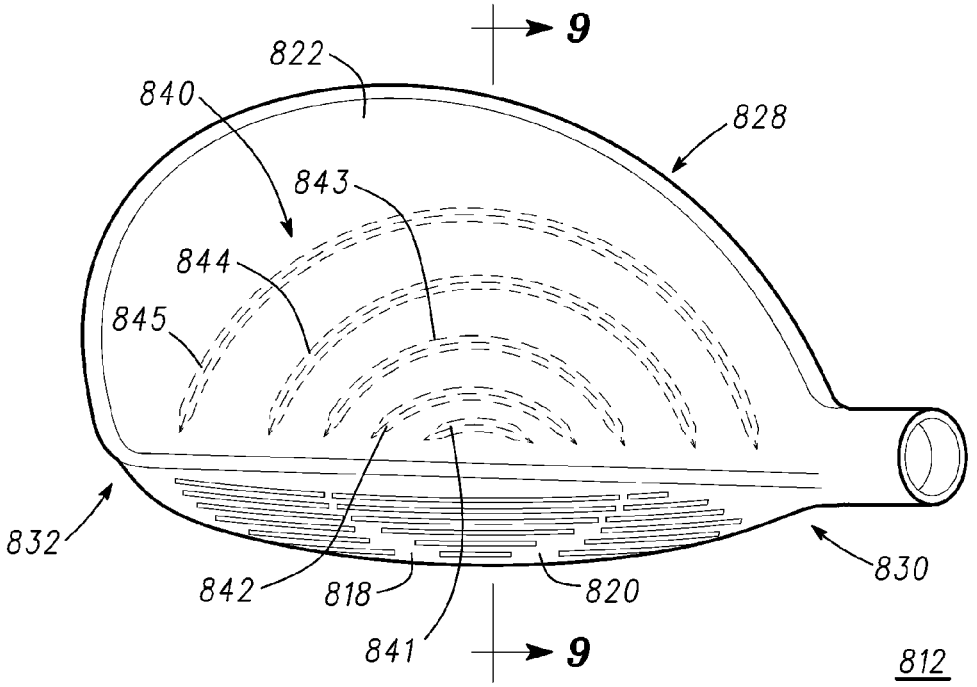
FIG. 8 is a top view of a golf club head, according to a fourth embodiment.
Figure 9:
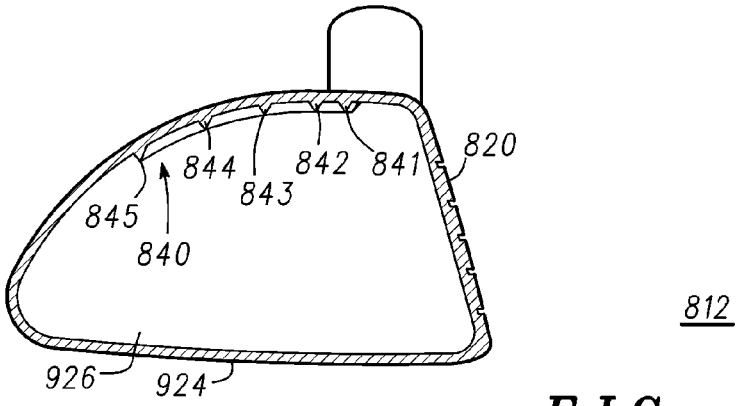
FIG. 9 is a full cross-sectional view of the club head of FIG. 8 viewed from the side.

FIG. 8 illustrates another embodiment of a golf club head. FIG. 9 illustrates a cross-sectional view of the embodiment of FIG. 8 taken at the lines labeled "9." Golf club head 812 (FIG. 8) includes a hollow body 818 (FIG. 8) with a front wall 820 (FIG. 8), a crown 822 (FIG. 8), a sole 924 (FIG. 9), a side wall 926 (FIG. 9) connecting crown 422 and sole 524, a heel end 830 (FIG. 8), a toe end 832 (FIG. 8), and a rear side 828 (FIG. 8) that is opposite of front wall 820. In addition, golf club head 812 can also include ribs 840 (FIG. 8) that extend downwardly from the lower surface of crown 822. In the example of the embodiment illustrated in FIG. 8, ribs 840 comprise ribs 841, 842, 843, 844, and 845 that have a first end that is proximal to toe end 832 and a second end that is proximal to heel end 830.

In some examples, one or more of ribs 840 can be curved. As an example, each of ribs 841, 842, 843, 844, and 845 are curved in the example of FIG. 8. In other examples, however, some of ribs 840 may not be curved. For example, rib 841 can be linear.

Each of ribs 840 of FIG. 8 are curved. In some examples, ribs 840 are all curved in the same direction. For example, ribs 841, 842, 843, 844, and 845 are curved concavely with respect to front wall 820. Therefore, the first end and second end of ribs 840 are curved toward front wall 820. It should be noted that there may be alternate curve arrangements for ribs 840. For example, some of ribs 840 may have a first end that is proximal to front wall 820 and a second end that is proximal to rear side 828. In addition, there may be less or more than six ribs 840.

Each of ribs 840 has a radius of curvature. In some examples, each of ribs 840 has a different radius of curvature. In other examples, some of the radii can be approximately equal.

In the example of golf club head 812 illustrated in FIG. 8, rib 841 has the smallest radius of curvature. The radius of curvature of the subsequent ribs increases the closer the rib is to rear end 828. For example, the radius of curvature of rib 842 is greater than that of rib 841; the radius of curvature of rib 843 is greater than that of rib 842; the radius of curvature of rib 844 is greater than that of rib 843; and the radius of curvature of rib 845 is greater than that of rib 844. In other examples the radii of curvature of ribs 840 can decrease for each rib that is closer to rear end 828. In yet other examples, the radii of curvature of ribs 840 have no relation to the rib's position relative to rear end 828.

In the same or other examples, the radii of curvature for the ribs can be such that the ribs are concentric. If each of ribs 840 was extrapolated to complete a circle, the resulting circles would be concentric. In other examples, the radii of curvature for ribs 840 are not concentric.

Each of ribs 840 has a width dimension. In the example of FIG. 8, each of ribs 840 has a width that is approximately equal to the other ribs. In other examples, ribs 840 can have widths that are not equal to the other ribs. In some examples, each of ribs 840 has a tapering first end and a tapering second end. In other examples, there is no tapering of the first end and/or the second end.

In addition, each of ribs 840 has a height dimension. The height dimension is a measure of the (curved) distance that a rib extends from crown 822 into hollow body 818. In the example of FIG. 9, each of ribs 840 has a height that is approximately equal to the heights of the other ribs. In other examples, ribs 840 can have heights that are not equal to the other ribs.

Each of ribs 840 has a length dimension also. The length dimension is a measure of the distance between a rib's first end and its second end. In the example of FIG. 8, the ribs closer to rear side 828 have a greater length than the ribs closer to front wall 820. As an example, rib 845 has the greatest length; the length of rib 844 is greater than that of rib 843; the length of rib 843 is greater than that of rib 842; and the length of rib 842 is greater than that of rib 841. In other examples, all of ribs 840 have an approximately equal length.

Figure 10:
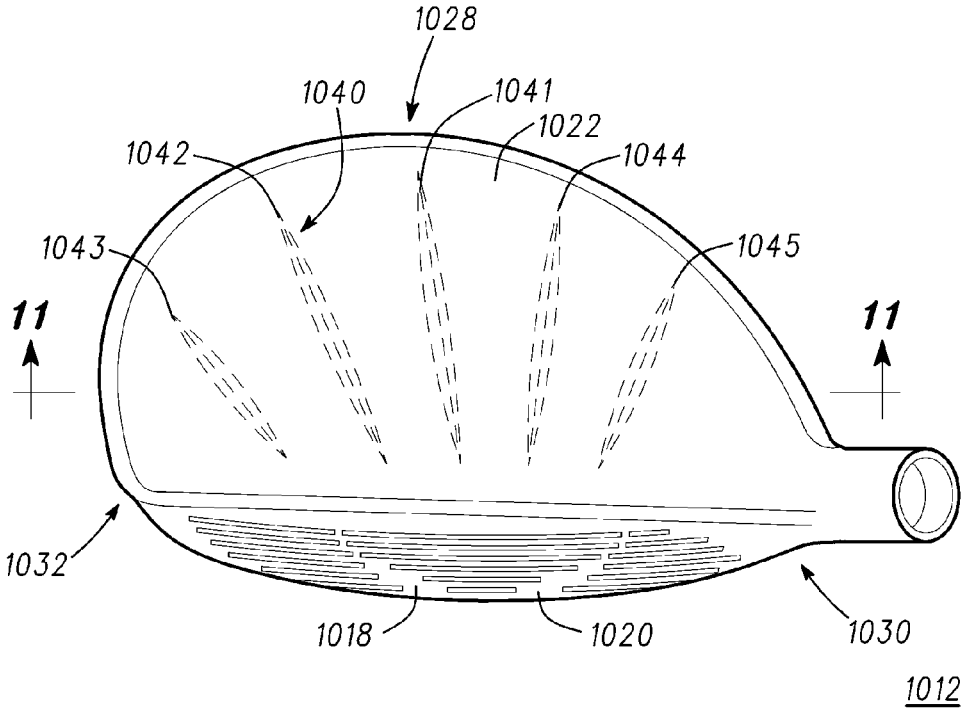
FIG. 10 is a top view of a golf club head, according to a fifth embodiment.
Figure 11:
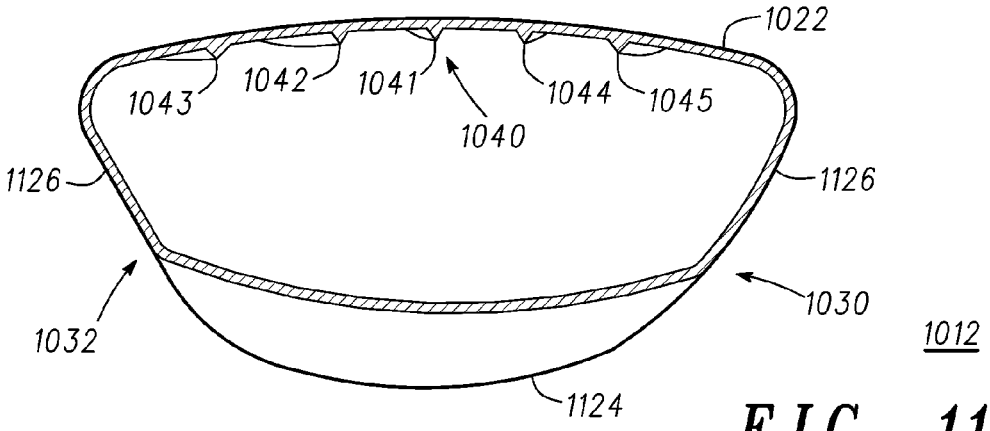
FIG. 11 is a full cross-sectional view of the club head of FIG. 10 viewed from the front.

In addition to having curved ribs, a golf club head can have ribs that have varying widths. For example. FIG. 10 illustrates another embodiment of a golf club head. FIG. 11 illustrates a cross-sectional view of the embodiment of FIG. 10 taken at the lines labeled "11." Golf club head 1012 (FIG. 10) includes a hollow body 1018 (FIG. 10) with a front wall 1020 (FIG. 10), a crown 1022 (FIG. 10), a sole 1124 (FIG. 11), a side wall 1126 (FIG. 11) connecting crown 1022 and sole 1124, a heel end 1030 (FIG. 10), a toe end 1032 (FIG. 10), and a rear side 1028 (FIG. 10) that is opposite of front wall 1020. In addition, golf club head 1012 can also include ribs 1040 (FIG. 10) that extend downwardly from the lower surface of crown 1022. In the example of the embodiment illustrated in FIG. 10, ribs 1040 comprise ribs 1041, 1042, 1043, 1044, and 1045 that have a first end that is proximal to front wall 1020 and a second end that is proximal to rear end 1028.

In some examples, one or more of ribs 1040 are linear. As an example, each of ribs 1041, 1042, 1043, 1044, and 1045 are linear in the example of FIG. 10. In other examples, however, some of ribs 1040 may not be linear. For example, one or more of ribs 1040 can be curved. In some examples, ribs 1040 are arranged so that each of the axes of ribs 1040 converge at a common point. In some examples, the common point is forward of the front wall. In other examples, each of the axes of ribs 1040 do not converge at a common point.

Each of ribs 1040 has a width dimension. In the example of FIG. 10, each of ribs 1040 has a width that tapers. For example, the width of each of ribs 1040 decreases from its midpoint to its first end and its second end. As demonstrated in FIG. 10, the width at the midpoint of each of ribs 1040 can be approximately equal to the width of each of the other ribs at their respective midpoints. In other examples, ribs 1040 can have widths at their midpoints that are not equal to the width of the other ribs at their respective midpoints.

The widths of ribs 1040 can taper at any rate. For example, as illustrated in FIG. 10, the widths can have a smooth, non-constant tapering, giving ribs 1040 the shape of an elongated oval. In other examples, the widths can taper in a linear or constant manner, giving ribs 1040 a shape similar to that of a diamond.

In addition, each of ribs 1040 has a height dimension. The height dimension is a measure of the distance that a rib extends from crown 1022 into hollow body 1018. In the example of FIG. 11, each of ribs 1040 has a height that tapers. For example, the height of each of ribs 1040 decreases from its midpoint to its first end and its second end. As demonstrated in FIG. 11, each of ribs 1040 can have a height that is approximately equal to the heights of the other ribs at their respective midpoints. In other examples, ribs 1040 can have heights at their midpoints that are not equal to the height of the other ribs at their respective midpoints.

The heights of ribs 1040 can taper at any rate. For example, as illustrated in FIG. 11, the widths can have a smooth, non-constant tapering, giving ribs 1040 a smooth contour. In other examples, the widths can taper more drastically or in a linear or constant manner, giving ribs 1040 a shape having a much more pointed height at the midpoint of ribs 1040.

Each of ribs 1040 has a length dimension also. The length dimension is a measure of the distance between a rib's first end and its second end. In the example of FIG. 10, the ribs closer to the midpoint between toe end 1032 and heel end 1030 have a greater length than the ribs closer to toe end 1032 or heel end 1030. As an example, rib 1041 has the greatest length; the length of rib 1042 is greater than that of rib 1043; and the length of rib 1044 is greater than that of rib 1045. In other examples, all of ribs 1040 have an approximately equal length.

Figure 12:
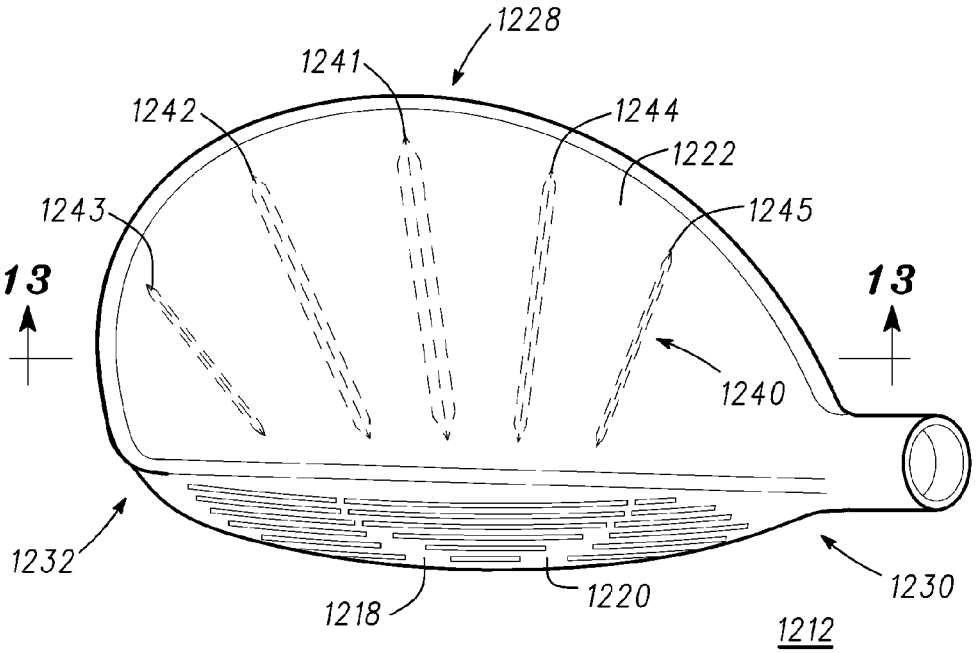
FIG. 12 is a top view of a golf club head, according to a sixth embodiment.
Figure 13:
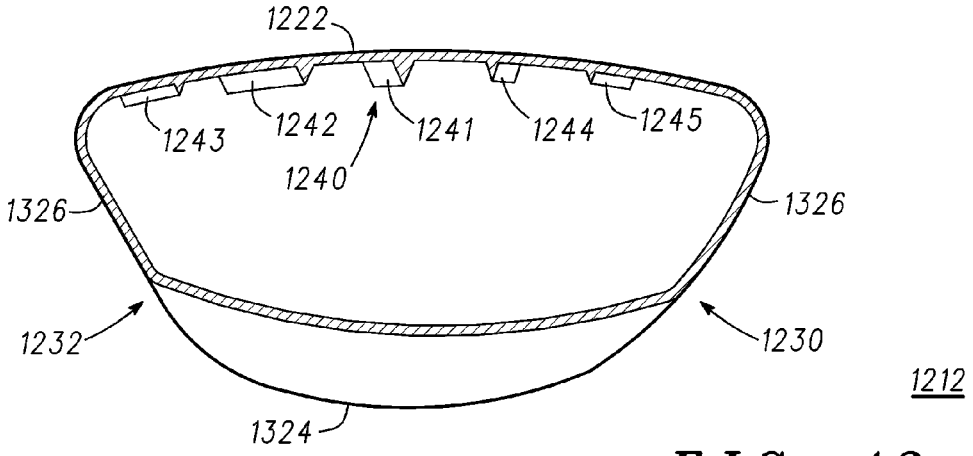
FIG. 13 is a full cross-sectional view of the club head of FIG. 12 viewed from the front.

FIG. 12 illustrates another embodiment of a golf club head. FIG. 13 illustrates a cross-sectional view of the embodiment of FIG. 12 taken at the lines labeled "13." Golf club head 1212 (FIG. 12) includes a hollow body 1218 (FIG. 12) with a front wall 1220 (FIG. 12), a crown 1222 (FIG. 12), a sole 1324 (FIG. 13), a side wall 1326 (FIG. 13) connecting crown 1222 and sole 1324, a heel end 1230 (FIG. 12), a toe end 1232 (FIG. 12), and a rear side 1228 (FIG. 12) that is opposite of front wall 1220. In addition, golf club head 1212 can also include ribs 1240 (FIG. 12) that extend downwardly from the lower surface of crown 1222. In the example of the embodiment illustrated in FIG. 12, ribs 1240 comprise ribs 1241, 1242, 1243, 1244, and 1245 that have a first end that is proximal to front wall 1220 and a second end that is proximal to rear end 1228.

In some examples, one or more of ribs 1240 are linear. As an example, each of ribs 1241, 1242, 1243, 1244, and 1245 are linear in the example of FIG. 12. In other examples, however, some of ribs 1240 may not be linear. For example, one or more of ribs 1240 can be curved. In some examples, ribs 1240 are arranged so that each of the axes of ribs 1240 converge at a common point. In some examples, the common point is forward of the front wall. In other examples, each of the axes of ribs 1240 do not converge at a common point.

Each of ribs 1240 has a width dimension. In the example of FIG. 12, each of ribs 1240 has a width that remains substantially constant. In some examples, the width of each of ribs 1240 tapers at its first end and its second end. In other examples, the width of each of ribs 1240 does not taper at its first and/or second end. As demonstrated in FIG. 12, the width of each of ribs 1040 can vary. For example, the closer a rib is to the midpoint between toe end 1232 and heel end 1230, the greater the width of that particular rib. As illustrated in FIG. 12, rib 1241 can have the largest width; the width of rib 1242 is greater than width of rib 1243; and the width of rib 1244 is greater that the width of rib 1245. In some examples, the widths of ribs 1240 are symmetric across golf club head 1212. For example, the width of rib 1243 is approximately equal to the width of rib 1245, and the width of rib 1242 is approximately equal to the width of rib 1244. In other examples, the widths of ribs 1240 are asymmetric across golf club head 1212. In yet other examples, the widths of ribs 1240 can change such as, for example, by increasing the closer the rib is to toe end 1232 or heel end 1230. In further examples, the widths of ribs 1240 have no correlation to the rib's position relative to toe end 1232 and/or heel end 1230. Ribs 1240 can be positioned so that the ribs with greater widths can be placed in areas of higher vibration.

In addition, each of ribs 1240 has a height dimension. The height dimension is a measure of the distance that a rib extends from crown 1222 into hollow body 1218. In the example of FIG. 13, each of ribs 1240 has a height that remains substantially constant. As also demonstrated in FIG. 13, each of ribs 1240 can have a height that is different from the height of at least one of the other ribs. In some examples, the height of ribs 1240 increases the closer a rib is to the midpoint between toe end 1232 and heel end 1230. As illustrated in FIG. 12, rib 1241 can have the largest height; the height of rib 1242 is greater than height of rib 1243; and the height of rib 1244 is greater that the height of rib 1245. In some examples, the heights of ribs 1240 are symmetric across golf club head 1212. For example, the height of rib 1243 is approximately equal to the height of rib 1245, and the height of rib 1242 is approximately equal to the height of rib 1244. In other examples, the heights of ribs 1240 are asymmetric across golf club head 1212. In yet other examples, the heights of ribs 1240 can change, such as, for example, by increasing the closer the rib is to toe end 1232 and heel end 1230. In further examples, the height of ribs 1240 has no correlation to the rib's position relative to toe end 1232 and/or heel end 1230. Ribs 1240 can be positioned so that the ribs with greater heights can be placed in areas of higher vibration.

Each of ribs 1240 has a length dimension also. The length dimension is a measure of the distance between a rib's first end and its second end. In the example of FIG. 12, the ribs closer to the midpoint between toe end 1232 and heel end 1230 have a greater length than the ribs closer to toe end 1232 or heel end 1230. As an example, rib 1241 has the greatest length; the length of rib 1242 is greater than that of rib 1243; and the length of rib 1244 is greater than that of rib 1245. In other examples, all of ribs 1240 have an approximately equal length.

In other embodiments, ribs can have widths and/or heights that taper and vary from one rib to the next. For examples, ribs can have tapering widths as illustrated by ribs 1040 of FIG. 10, and ribs can have varying widths as illustrated by ribs 1240 of FIG. 12. In addition, ribs can have tapering heights as illustrated by ribs 1040 of FIG. 11, and ribs can have a varying heights as illustrated by ribs 1240 of FIG. 13.

In another embodiment, a method of providing a golf club head is provided. The method of providing a golf club head can include providing a body having a heel end, a toe end, a crown having an upper surface and a lower surface, a sole, a front wall, a rear side, and ribs extending from a first end to a second end and extending downwardly from the lower surface of the crown. In addition, the ribs can comprise a first rib and at least one second rib that is curved. As an example, the heel end can be heel end 430 (FIG. 4), heel end 630 (FIG. 6), or heel end 830 (FIG. 8); the toe end can be toe end 432 (FIG. 4), toe end 632 (FIG. 6), or toe end 832 (FIG. 8); the crown can be crown 422 (FIG. 4), crown 622 (FIG. 6), or crown 822 (FIG. 8); the sole can be sole 524 (FIG. 5), sole 724 (FIG. 7), or sole 924 (FIG. 9); the front wall can be front wall 420 (FIG. 4), front wall 620 (FIG. 6), or front wall 820 (FIG. 8); the rear side can be rear side 428 (FIG. 4), rear side 628 (FIG. 6), or rear side 828 (FIG. 8); and ribs can be ribs 440 (FIG. 4), ribs 640 (FIG. 6), or ribs 840 (FIG. 8).

In one example, the ribs can be provided to be integral with the body. In other examples, the ribs can be provided to be initially separate from the body. Afterwards, the ribs can be coupled to the body by way of a brazing technique, a welding technique, or an adhesive.

In yet another embodiment, a method of providing a golf club head is provided. The method of providing a golf club head can include providing a body having a heel end, a toe end, a crown having an upper surface and a lower surface, a sole, a front wall, a rear side, and generally linear ribs extending downwardly from the lower surface of the crown and extending from a first end proximal the front wall to a second end proximal the rear side. In some examples, the ribs can have a tapering width from its midpoint towards its ends. In the same or other examples, the widths of at least two of the ribs are different. As an example, the heel end can be heel end 1030 (FIG. 10) or heel end 1230 (FIG. 12); the toe end can be toe end 1032 (FIG. 10) or toe end 1232 (FIG. 12); the crown can be crown 1022 (FIG. 10) or crown 1222 (FIG. 12); the sole can be sole 1124 (FIG. 11) or sole 1324 (FIG. 13); the front wall can be front wall 1020 (FIG. 10) or front wall 1220 (FIG. 12); the rear side can be rear side 1028 (FIG. 10) or rear side 1228 (FIG. 12); and ribs can be ribs 1040 (FIG. 10) or ribs 1240 (FIG. 12).

In one example, the ribs can be provided to be integral with the body. In other examples, the ribs can be provided to be initially separate from the body. Afterwards, the ribs can be coupled to the body by way of a brazing technique, a welding technique, or an adhesive.

Figure 14:
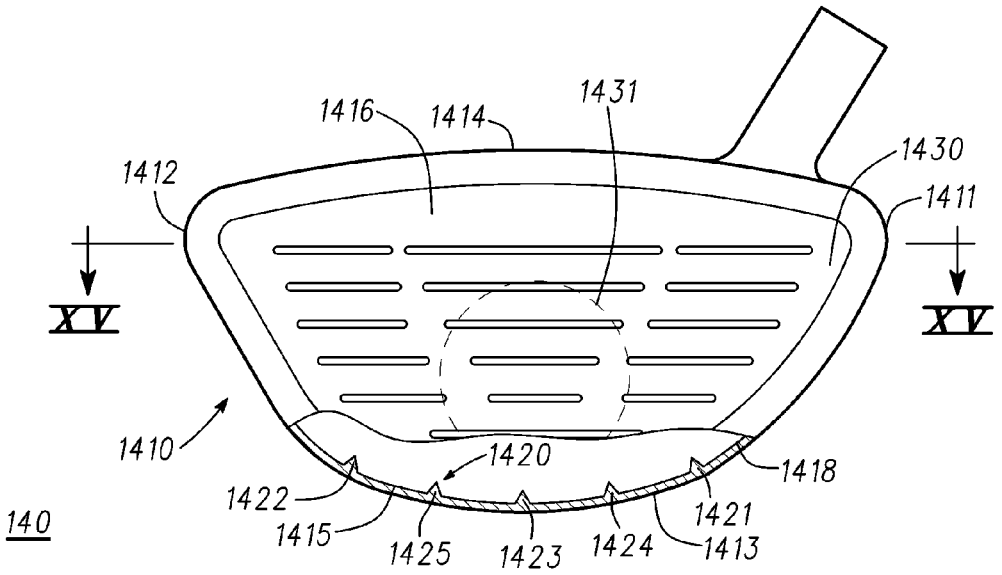
FIG. 14 is a partial front cross-sectional view of a golf club head according to another embodiment.
Figure 15:
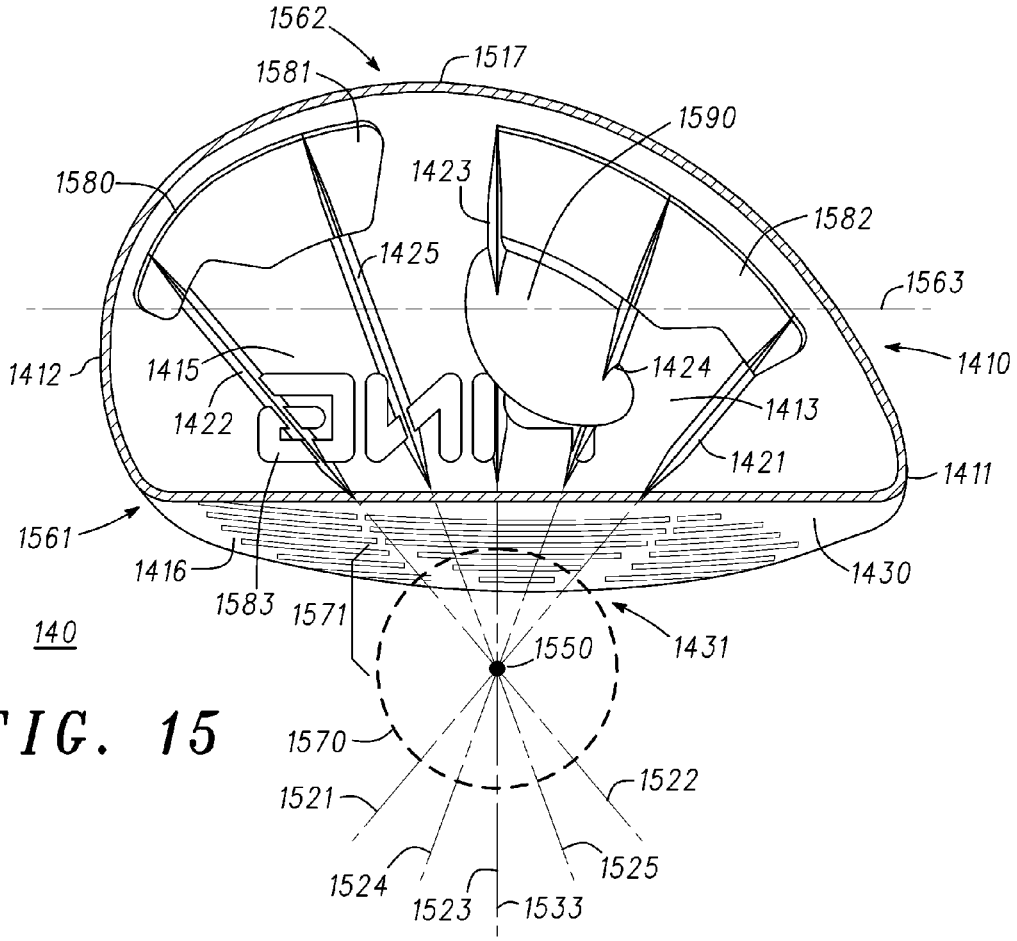
FIG. 15 is a top cross-sectional view of the golf club head of FIG. 14 with respect to line XV-XV of FIG. 14.

Continuing with the figures, FIG. 14 illustrates a partial front cross-sectional view of golf club head 140. FIG. 15 illustrates a top cross-sectional view of golf club head 140 with respect to line XV-XV of FIG. 14. Golf club head 140 is similar to other golf club heads presented herein, such as golf club head 12 (FIGS. 1-4), but differs by comprising ribs 1420 located at rib surface 1415, where rib surface 1415 is defined by the extension of ribs 1420 and the space therebetween. In the present example, ribs 1420 comprise a single piece of material with rib surface 1415, but there may be other embodiments where ribs 1420 may not be integral with rib surface 1415 and could be secured thereto via one or more mechanical or chemical fasteners.

Oftentimes, players or users of golf clubs can be able to gauge the quality of their hits based on the sound that the golf club head makes at impact with a golf ball. The ability to keep a consistent sound at impact can thus be an advantage for keeping such players or users within their comfort zone and/or for maintaining expectations regarding such sound/quality relationship. Considering the above, ribs 1420 can be configured in some embodiments to channel stresses and/or vibrations to achieve a desired impact sound when golf club head 140 impacts a golf ball such as golf ball 1570 (FIG. 15). Such a characteristic may be valuable to maintain and/or restore a desired sound characteristic for the golf club head design, such as when the desired sound characteristic would otherwise be altered as a result of other modifications or improvements made to the structure of the golf club head design in search of better performance. In addition, as previously described with respect to other golf club heads herein disclosed, ribs 1420 may add reinforcement characteristics to the portion of the club head where rib surface 1415 is located to better dissipate or channel stress or impact forces.

Golf club head 140 comprises body 1410 having heel end 1411, toe end 1412, sole 1413, crown 1414, front surface 1416 (comprising strike face 1430 and target strike zone 1431), rear surface 1517 (FIG. 15), and skirt portion 1418. Body 1410 also comprises rib surface 1415, from which ribs 1420 protrude. In the present example, ribs 1420 comprise rib 1421 with rib longitudinal axis 1521 (FIG. 15), rib 1422 with rib longitudinal axis 1522 (FIG. 15), and rib 1423 with rib longitudinal axis 1523 (FIG. 15), where rib longitudinal axes 1521-1523 intersect external to body 1410 at common point 1550 (FIG. 15). Rib 1421 is located closest to heel end 1411, rib 1422 is located closest to toe end 1412 of body 1410, and rib 1423 is located between ribs 1411 and 1412. Ribs 1420 are arranged on or over rib surface 1415 in a substantially radial pattern in the present example, forming a fan-like shape between rib 1421 and rib 1422. Common point 1550 is located forward of front surface 1416 in the present embodiment, but there can be embodiments where common point 1550 is located elsewhere external to body 1410. As an example, a different embodiment could comprise ribs similar to ribs 1420 but configured to intersect at a common point located behind rear surface 1517.

Ribs 1420 also comprise rib 1424 with longitudinal axis 1524, and rib 1425 with longitudinal axis 1525. In the present example, longitudinal axes 1524 and 1525 also intersect at common point 15500 with longitudinal axes 1521-1523. There can be other embodiments, however, where not all longitudinal axes of ribs 1420 need to intersect at common point 15500. As an example, there can be embodiments where longitudinal axes 1524 and 1525 may intersect each other external to body 1410 but elsewhere other than at common point 15500. Other embodiments may comprise a different number of ribs. As an example, ribs 1423-25 may be absent in some embodiments, such that ribs 1420 would comprise only two ribs. As another example, some embodiments may comprise more than five ribs, such as an embodiment with 10 ribs similar to that described with respect to FIGS. 1-3 but with ribs at sole 24 (FIG. 3). Some of such embodiments may comprise ribs that may not intersect with all of the other ribs thereof.

In the present example of FIG. 15, rib surface 1415 is located at sole 1413 internal to body 1410, such that ribs 1420 are also internal to body 1410 and invisible at sole 1413 opposite rib surface 1415. In other examples, however, ribs 1420 may be external to body 1410, where rib surface could be located, instead, at an exterior surface of crown 1414 or at an exterior surface of sole 1413. Ribs 1420 are concave relative to crown 1414 in the present example, and rib surface 1415 extends past sole 1413 into part of skirt portion 1418 of body 1410. There can be other embodiments, however, where ribs 1420 need not extend into skirt portion 1418. In some examples, extending ribs 1420 into skirt portion 1418 can be beneficial for reinforcing one or more sections of skirt portion 1418, and/or for tuning the impact sound of golf club head 140.

As can be seen in FIG. 15, each of ribs 1420 are spaced apart from front surface 1416 and from rear surface 1517. Such a characteristic can be beneficial, for example, so as to not interfere with the bending or deformation of the transition region between front surface 1416 and the rest of body 1410 upon impact with a golf ball. Also in the present example, different ribs of ribs 1420 are separated by different distances from front surface 1416 along their respective longitudinal rib axes. As an example, rib 1423 is spaced apart from front surface 1416 along rib longitudinal axis 1523 by a distance greater than the distance spacing apart ribs 1421 and/or 1422 from front surface 1416 along rib longitudinally axes 1521 and/or 1522, respectively. In the present embodiment, rib 1421 is spaced apart from front surface 1416 by approximately 1.732 cm, rib 1422 is spaced apart from front surface 1416 by approximately 1.638 cm, rib 1423 is spaced apart from front surface 1416 by approximately 1.742 cm, rib 1424 is spaced apart from front surface 1416 by approximately 1.737 cm, and rib 1425 is spaced apart from front surface 1416 by approximately 1.709 cm. Such different spacing may be valuable in some examples for influencing or tuning the stiffness of the transition region between strike face 1430 and sole 1413 to control one or more attributes of golf club head 140, such as a characteristic time, a coefficient of restitution, an impact sound, and/or a feel thereof. In other examples, ribs 1420 may be equally spaced apart from front surface 1416.

In the present embodiment, rib 1421 comprises a length of approximately 4.1 cm, rib 1422 comprises a length of approximately 7.3 cm, rib 1423 comprises a length of approximately 8.6 cm, and rib 1424 comprises a length of approximately 6.5 cm, rib 1425 comprises a length of approximately 8.8 cm. The lengths of ribs 1420 can extend through and/or above indentations or other features of rib surface 1415, such as indentations 1580 including indentations 1581-1583. Indentations 1580 may thus partially engulf one or more portions of one or more of ribs 1420, as can be seen in the example of FIG. 15. As an example, parts of the top of ribs 1422 and 1425 are shown protruding above indentation 1581, while parts of the top of ribs 1421, 1424, and 1423 are shown protruding above indentation 1582. As another example, parts of ribs 1422-1425 are shown protruding above indentations 1583. Indentations 1581-1583 all protrude from rib surface 1415 into an interior of golf club head 140 in the embodiment of FIGS. 14-15, where indentations 1581-1582 delineate pockets into which external weights can be attached to an exterior surface of golf club head 140, and where indentations 1583 can correspond to a logo or other design located or embossed at rib surface 1415. There can be other embodiments, however, where one or more of ribs 1420 may not protrude above one or more of indentations 1580. As an example, in another embodiment, ribs 1420 may protrude above indentations 1583, while the length of one or more of ribs 1420 may end at the interface with one or more of indentations 1581-1582. In the same or other embodiments, one or more of indentations 1580 may completely engulf at least one portion of one or more of ribs 1420.

Ribs 1420 can be configured to comprise a maximum width of approximately 4.5 millimeters (mm) to approximately 5 mm, and/or a maximum thickness of approximately 0.5 to approximately 1.0 mm in some embodiments. More specifically, in the present example of FIGS. 14-15, the maximum width of ribs 1420 can be of approximately 4.8 mm, and the maximum thickness of ribs 1420 can be approximately 0.76 mm.

Ribs 1420 are non-intersected by any rib in the present example. In addition, the thickness and width of ribs 1420 blend into rib surface 1415 proximate to front surface 1416. Such characteristics may permit ribs 1420 to better pick up or channel stresses and/or vibrations along their length for dissipation towards or throughout desired portions of body 1410 without interruption or deviation of such channeling by any intersecting rib. The blending of ribs 1420 into rib surface 1415 may also permit a reduction of stress concentration than if ribs 1420 protruded abruptly proximate to front surface 1416. Other embodiments, however, may comprise one or more ribs that may or may not intersect all of ribs 1420, and/or one or more of ribs 1420 that may not blend into rib surface 1415.

In the present example, as can be seen in FIG. 15, adjacent ribs of ribs 1420 diverge from each other towards rear surface 1517, and converge towards each other towards front surface 1416. Also, body 1410 comprises forward portion 1561 and rearward portion 1562, divided by midline 1563 therebetween, where midline 1563 lies generally parallel to front surface 1416 at substantially one-half the distance between a forwardmost point of front surface 1416 and a rearwardmost point of rear surface 1517. In the present example, the front end of each of ribs 1422-1425 lies at forward portion 1561, while the rear end of each of ribs 1422-1425 lies at rearward portion 1562. There can be examples where all of ribs 1420 comprise front ends at forward portion 1561 and rear ends at rearward portion 1562. Also, in the present example, ribs 1420 are located such that their collective center of gravity is located between the center of gravity of golf club head 140 and rear surface 1517. In the same or other examples, the center of gravity of each of ribs 1420 may be located between the center of gravity of golf club head 140 and rear surface 1517. As a result, ribs 1420 may beneficially displace the center of gravity of golf club head 140 rearwards from where it would have otherwise been for better impact and launch characteristics.

The embodiment of FIGS. 14-15 also present a target strike zone 1431 at front surface 1416, configured to be the desired point of impact with a golf ball under most circumstances. In the present example, longitudinal axis 1523 of rib 1423 is substantially perpendicular to strike face 1430, and is aligned with a center of target strike zone 1431. Target strike axis 1533 extends substantially perpendicular to strike face 1430, from a center of target strike zone 1431, where common point 1550 is located along target strike axis 1533 in the present embodiment such that ribs longitudinal axes 1521-1525 of ribs 1421-1425 intersect each other along target strike axis 1533. Rib longitudinal axis 1523 can be collinear with target strike axis 1533.

As seen in FIG. 15, common point 1550 is separated from target strike zone 1431 by distance 1571 comprising approximately a radius of golf ball 1570. In some examples, distance 1571 may be of approximately 21.3 mm, and/or tailored with respect to the radius of a golf ball compliant with the rules of the United States Golf Association (USGA). Currently, the USGA requires conforming golf balls to have a diameter of not less than 1.680 inches (42.67 mm). In other examples, common point 1550 may be separated from target strike zone 1431 by a different distance, such as a distance of a golf ball diameter, instead.

In the present example, golf club head 140 comprises sole weight 1590 located at least partially at sole 1413. Sole weight 1590 is situated at a lowermost portion of sole 1413, so as to more effectively lower the center of gravity of golf club head 140, and the perimeter of sole weight 1590 can be contoured to fill-in the volume of such lowermost portion of sole 1413. In the same or other examples, sole weight 1590 comprises a single piece of material with sole 1413 in the present example, but there may be other examples where sole weight 1590 may comprise a different material or piece than sole 1413, and/or where sole weight 1590 may be affixed to sole 1413 via a mechanical or chemical fastener such as via an adhesive, one or more screws, welding, and/or brazing, among others. As shown in FIG. 15, sole weight 1590 may at least partially engulf one or more ribs of ribs 1420, such as ribs 1423-1424. In the same or other examples, the thickness of sole weight 1590 can engulf a thickness of one or more portions of the engulfed ribs, such as seen with respect to the portions of ribs 1423-1424 that become subsumed into the thickness of sole weight 1590.

Figure 17:
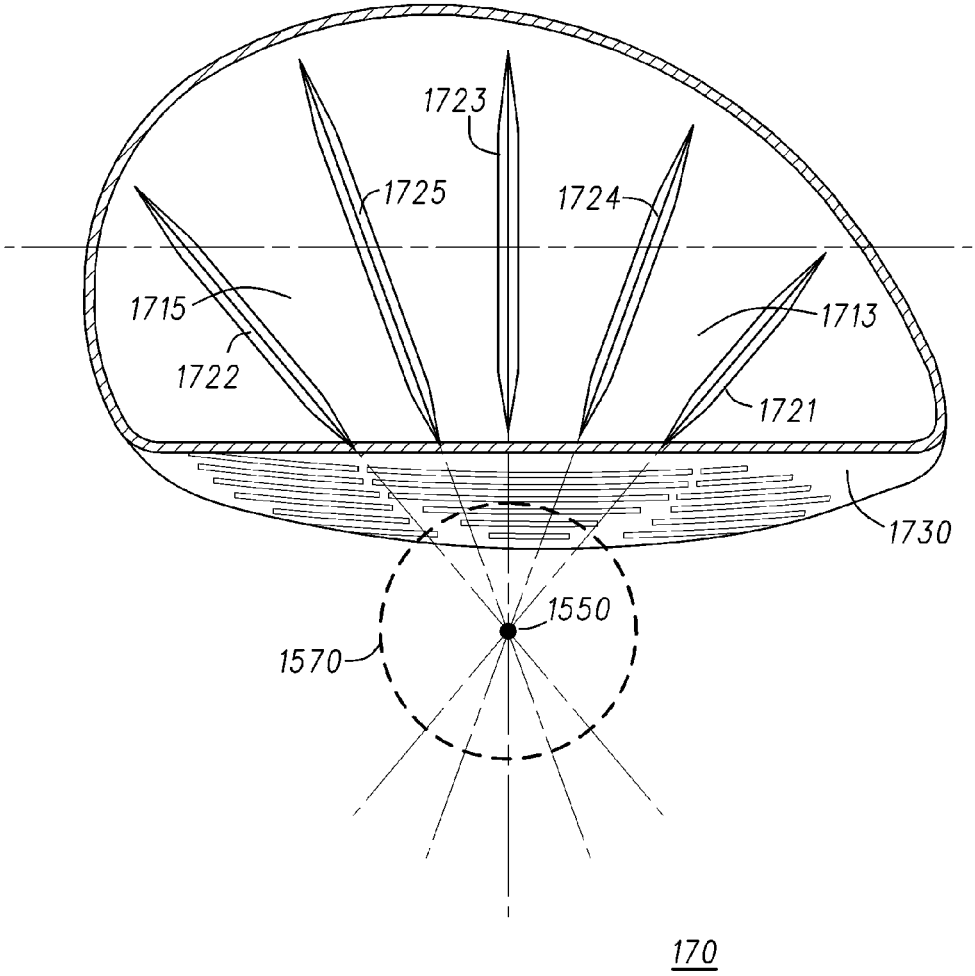
FIG. 17 illustrates a top cross-sectional view of a golf club head similar to the golf club head of FIGS. 14-15 but according to another embodiment.

Skipping ahead in the figures, FIG. 17 illustrates a top cross-sectional view of golf club head 170. In the present example, club head 170 is similar to golf club head 140 (FIGS. 14-15), and comprises ribs 1721-1725 similar to ribs 1421-1425 (FIGS. 14-15). Ribs 1721-1725 are located at rib surface 1715, which is devoid of features such as weight 1590 and indentations 1581-1583 that could otherwise engulf one or more portions of ribs 1721-1725. There can be other examples, however, where one or more indentations like indentations 1581-1583, and/or one or more weights like weight 1590, could be located at rib surface 1715.

Figure 16:
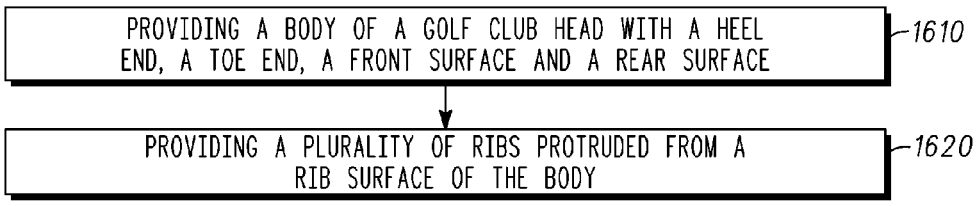
FIG. 16 illustrates a flowchart of a method for providing a golf club head in accordance with examples and embodiments of the present disclosure.

Backtracking through the figures, FIG. 16 illustrates a flowchart of a method 1600 for providing a golf club head. In some examples, the golf club head can be similar to one or more of the golf club heads previously described, such as golf club head 12 (FIGS. 1-3), golf club head 412 (FIGS. 4-5), golf club head 1012 (FIGS. 10-11), golf club head 1212 (FIGS. 12-13), golf club head 140 (FIGS. 14-15), and/or variations thereof.

Block 1610 of method 1600 comprises providing a body of the golf club head with a heel end, a toe end, a sole, a front surface, and a rear surface. As an example, with respect to the embodiment of FIGS. 14-15, the body can be similar to body 1410, the toe end can be similar to toe end 1412, the heel end can be similar to heel end 1411, the sole can be similar to sole 1413, the front surface can be similar to front surface 1416, and the rear surface can be similar to rear surface 1517. Corresponding associations are envisioned for other golf club heads taught herein, or variations thereof.

Block 1620 of method 1600 comprises providing a plurality of ribs protruded from a rib surface of the body. As an example, with respect to the embodiment of FIGS. 14-15, the rib surface can be similar to rib surface 1415, and the plurality of ribs can be similar to a plurality of ribs 1420. For instance, the plurality of ribs may comprise a subset of ribs 1421-1425. Corresponding associations can be made with respect to ribs of the other golf club heads taught herein, or variations thereof. In some embodiments, at least a subset of the plurality of ribs may intersect at a common point external to the body, such as illustrated with respect to common point 1550 located forward of front surface 1416 in FIG. 15, for example. There can be other examples, however, where common point need not be located forward of the front surface of the body. In addition, the plurality of ribs may comprise a single piece of material with the rib surface, or may be attached thereto via a mechanical or chemical fastener.

In some examples, providing the plurality of ribs in block 1620 can comprise providing the rib surface and the plurality of ribs internal to the body; and/or providing the plurality of ribs at the sole of the body. In other examples, the plurality of ribs may be external to the body instead, and/or the plurality of ribs may be provided elsewhere, such as at a crown of the body, and/or at a skirt portion of the body.

There can be examples where different blocks of method 1600 can be combined into a single block or performed simultaneously, and/or the sequence of such blocks can be changed. For example, blocks 1610-1620 may be performed simultaneously, such as by forming the plurality of ribs integrally with the rib surface, where the rib surface comprises one or more portions of one or more parts of the body of the club head. There can also be examples where method 1600 can comprise further or different blocks. As an example, method 1600 can comprise another block for providing a weight similar to sole weight 1590 (FIG. 15), where such weight could engulf one or more portions of one or more of the plurality of ribs of block 1620. Other variations can be implemented for method 1600 without departing from the scope of the present disclosure.

Figure 18:
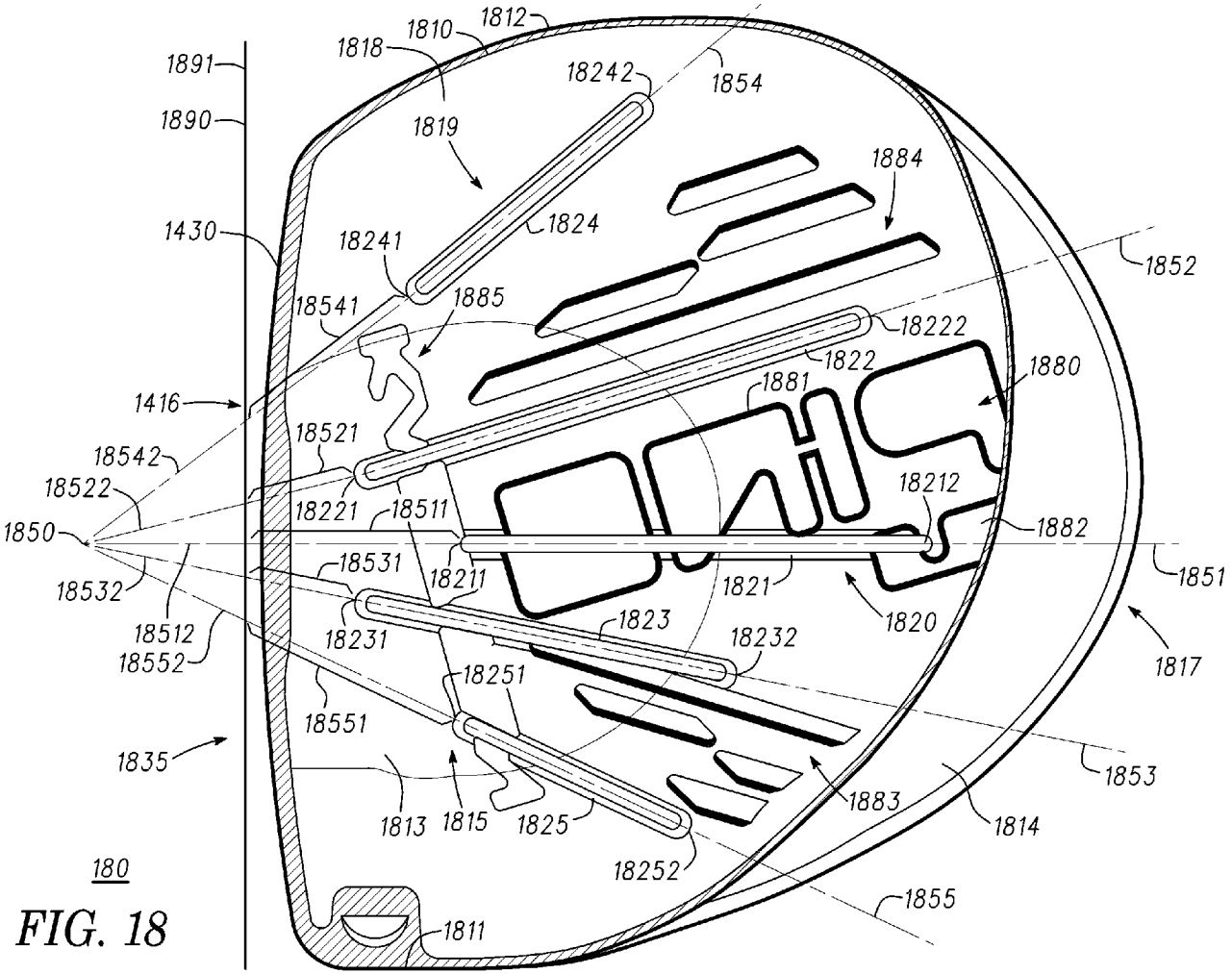
FIG. 18 illustrates a top cross-sectional view of a golf club head according to another embodiment.
Figure 21:
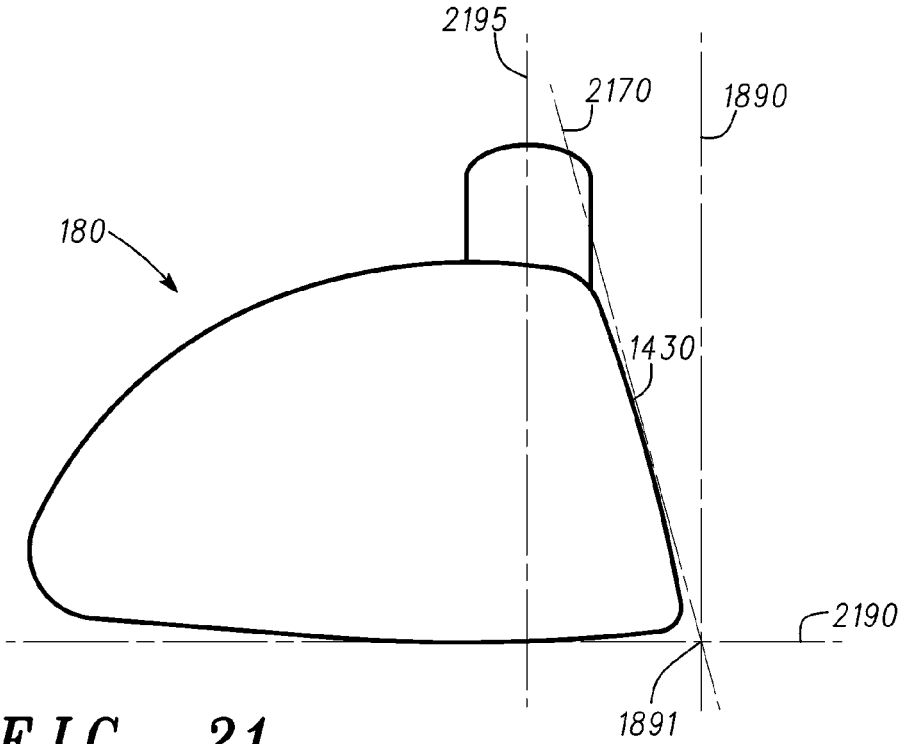
FIG. 21 illustrates a side view of the golf club head of FIG. 18 at address

Moving along, FIG. 18 illustrates a top cross-sectional view of golf club head 180. Skipping ahead in the figures, FIG. 21 illustrates a side view of golf club head 180 at address. Golf club head 180 comprises several ribs, and is similar in many respects to other golf club heads presented herein, such as golf club head 12 (FIGS. 1-4), golf club head 140 (FIGS. 14-15), and golf club heads 170 (FIG. 17). Golf club head 180 comprises ribs 1820 in a staggered pattern including ribs 1821-1825 that protrude from rib surface 1815. Rib surface 1815 can be similar to rib surface 1415 (FIGS. 14-15), but is defined by the extension of ribs 1820 and the space therebetween. In the present example, ribs 1820 comprise a single piece of material with rib surface 1815, but there may be other embodiments where ribs 1820 need not be integral with rib surface 1815 and could be secured thereto via one or more mechanical, chemical, or other fasteners. Although ribs 1820 are shown in FIG. 18 as straight ribs, there can be embodiments with corresponding curved rib(s) that can still exhibit the staggered pattern characteristics described herein. In such embodiments, the curved rib(s) can curve similar to the ribs in FIGS. 4, 6, and/or 9, among other configurations.

Golf club head 180 comprises body 1810 having heel end 1811, toe end 1812, sole 1813, crown 1814, front surface 1416, (comprising strike face 1430 and target strike zone 1431, as seen in FIG. 14), and rear surface 1817. Golf club head 180 also comprises loft plane 2170 (FIG. 21), which is tangent to a strikeface centerpoint of strikeface 1430. In some examples the strikeface centerpoint can be located at a center of target strike zone 1431 (FIG. 14), and/or may be defined in accordance with the definition of a golf governing body such as the United States Golf Association (USGA). For example, the strikeface centerpoint can be determined in accordance with Section 6.1 of the USGA's Procedure for Measuring the Flexibility of a Golf Clubhead (USGA-TPX3004, Rev. 1.0.0, May 1, 2008) (available at http://www.usga.org/equipment/testing/protocols/Procedure-For-Measuring-The-Flexability-Of-A-Golf-Club-Head/).

Golf club head 180 can be configured such that, when it is at address, with the vertical component of shaft axis 2195 orthogonal to ground flat surface 2190 as seen in FIG. 21, loft plane 2170 intersects ground flat surface 2190 along front intersection line 1891, from which front plane 1890 extends orthogonal to ground flat surface 2190. In some examples relative distances of ribs 1820 can be measured with respect to front plane 1890 or loft plane 2170.

In the present example, rib surface 1815 is located at sole 1813 and skirt portion 1818, and is internal to body 1810, such that ribs 1820 are also internal to body 1810. Ribs 1821-1823 are located at least partially at sole 1813 in the present example, and extend into skirt portion 1818 along with ribs 1824 and 1825 to reinforce one or more sections of skirt portion 1818. In the same or other examples, such extension of at least some of ribs 1820 into skirt portion 1818 can adjust the impact sound of golf club head 180 to a desired level or frequency. There also can be other examples where rib surface 1815 can be located elsewhere in body 1810, such as at crown 1814, and/or where rib surface 1815 can be located only at sole 1813 or only at skirt portion 1818. Rib surface 1815 also can be located at an exterior of body 1810, and can be visible from the exterior of body 1810 in some implementations, such that ribs 1820 would instead protrude towards the exterior of body 1810.

Ribs 1820 of golf club head 180 are similar to other ribs presented herein, such as ribs 34 of golf club head 12 (FIGS. 1-3), ribs 440 of golf club head 412 (FIGS. 4-5), ribs 640 of golf club head 612 (FIGS. 6-7), ribs 840 of golf club head 812 (FIGS. 8-9), ribs 1040 of golf club head 1012 (FIG. 10), ribs 1240 of golf club head 1212 (FIGS. 12-13), ribs 1420 of golf club head 140 (FIGS. 14-15), and/or the ribs of golf club head 170 (FIG. 17), regardless of whether such ribs are located at the crown, sole, skirt, or other portions of their respective golf club heads. In the present example, ribs 1821-1825 are aligned in a staggered pattern with respect to front surface 1416, front plane 1890, and/or relative to loft plane 2170 (FIG. 21).

Ribs 1820 comprise five ribs (i.e., ribs 1821-1825) in the present implementation. Rib 1821 comprises rib end 18211 and rib end 18212 opposite rib end 18211, where rib axis 1851 extends through rib ends 18211-18212. Rib 1822 comprises rib end 18221 and rib end 18222 opposite rib end 18221, where rib axis 1852 extends through rib ends 18221-18222. Rib 1823 comprises rib end 18231 and rib end 18232 opposite rib end 18231, where rib axis 1853 extends through rib ends 18231-18232. Rib 1824 comprises rib end 18241 and rib end 18242 opposite rib end 18241, where rib axis 1854 extends through rib ends 18241-18242. Rib 1825 comprises rib end 18251 and rib end 18252 opposite rib end 18251, where rib axis 1855 extends through rib ends 18251-18252. There can be other embodiments, however, where ribs 1820 can comprise more or less than five ribs. For example, in one such embodiment, ribs 1820 can comprise a subset of ribs 1821-1825, such as only ribs 1821-1823, or such as only ribs 1821, 1824, and 1825. As another example, in another embodiment, ribs 1820 can comprise further ribs, which may be interspersed proximate or between two or more of ribs 1821-1825.

In the current embodiment, rib 1821 is located between ribs 1822 and 1823; rib 1822 is located between rib 1821 and rib 1824; and rib 1823 is located between rib 1821 and rib 1825. Ribs 1820 are aligned such that rib 1822 is located between rib 1821 and toe end 1812 of body 1810, and such that rib 1823 is located between rib 1821 and heel end 1811 of body 1810. As can be seen in FIG. 8, ribs 1821-1823 are non-intersected by any other rib or each other, although there can be other embodiments where at least some ribs of ribs 1820 can be intersected by other ribs.

Rib 1821 is aligned such that, from the top view perspective of FIG. 18, rib axis 1851 is substantially orthogonal relative to front plane 1890 and substantially aligned with target strike zone 1431 (FIG. 14). There can be other embodiments, however, where rib axis 1851 need not be substantially orthogonal to front plane 1890 and/or where rib axis 1851 need not be substantially aligned with target strike zone 1431, depending on the desired configuration and/or based on the area(s) of body 1810 of golf club head 180 needing reinforcement by ribs 1820.

Ribs 1820 also comprise different lengths relative to each other in the present example. For instance, in the present example, rib 1821 comprises a rib length of approximately 64 mm from rib end 18211 to rib end 18212, rib 1822 comprises a rib length of approximately 70 mm from rib end 18221 to rib end 18222, rib 1823 comprises a rib length of approximately 51 mm from rib end 18231 to rib end 18232, rib 1824 comprises a rib length of approximately 38 mm from rib end 18241 to rib end 18242, and rib 1825 comprises a rib length of approximately 32 mm from rib end 18251 to rib end 18252. In the present example, the rib length of rib 1822 is greater than the rib length of rib 1823 and greater than the rib length of rib 1821. There can be other embodiments, however, where the rib length of rib 1821 can be greater than the rib length of ribs 1822-1823, and/or where the rib lengths of ribs 1822-1823 can be substantially equal to each other.

In some examples, rib lengths for straight ribs, such as ribs 1820, can range individually between approximately 20 mm to approximately 130 mm. In other examples having curved rib(s), such as those having rib(s) with curvature(s) similar to those of the ribs in FIG. 4, 6 or 9, the rib length for individual ribs can range between approximately 20 mm to approximately 205 mm. In addition, each of ribs 1820 comprises a rib width of approximately 3 mm, but there can be other embodiments where individual rib widths can be of up to approximately 10 mm, where the rib widths can be non-uniform along their rib lengths, and/or where the rib widths can be unique relative to other ribs. Furthermore, each of ribs 1820 comprise a rib height of approximately 3 mm, but there can be other embodiments where individual rib heights can be of up to approximately 10 mm, where the rib heights can be non-uniform along their rib lengths, and/or where the rib heights can be unique relative to other ribs.

Rib axis 1851 comprises distance 18511 between front plane 1890 and rib end 18211. Similarly, rib axis 1852 of rib 1822 comprises distance 18521 between front plane 1890 and rib end 18221, while rib axis 1853 of rib 1823 comprises distance 18531 between front plane 1890 and rib end 18231. In addition, rib axis 1854 of rib 1824 comprises distance 18541 between front plane 1890 and rib end 18241, while rib axis 1855 of rib 1825 comprises distance 18551 between front plane 1890 and rib end 18251. In the present example, distance 18511 can be of approximately 32 mm, distance 18521 can be of approximately 20 mm, distance 18531 can be of approximately 20 mm, distance 18541 can be of approximately 34 mm, and distance 18551 can be of approximately 36 mm. There can also be examples where distances 18511, 18521, 18531, 18541, and/or 18551 can vary within 15% of the numbers listed above. Although distances 18511, 18521, 18531, 18541, and 18551 represent distances between ribs 1820 and front plane 1890, corresponding distances between ribs 1820 and one or both of front surface 1416 or loft plane 2170 (FIG. 21) can be similar to such distances 18511, 18521, 18531, 18541, and/or 18551 in the same or other examples.

As can be seen in FIG. 18, distance 18511 of rib 1821 is greater than distance 18521 of rib 1822, and greater than distance 18531 of rib 1823, such that rib 1821 is further separated from front plane 1890 than either of ribs 1822-1823, thus yielding a staggered pattern therebetween. Although in the present embodiment distance 18531 of rib 1823 is approximately equal to distance 18521 of rib 1822, there can be other embodiments where distances 18521 and 18531 can substantially differ from each other.

In addition, in the present embodiment, distance 18541 of rib 1824 is different than distance 18521 of rib 1822, and different than distance 18511 of rib 1821. For example, distance 18541 is greater than distance 18521 and can be greater than distance 18511 in the present example, although there can be examples where distance 18541 is greater than only one of distance 18521 or distance 18511. In addition, there can be other embodiments where distance 18541 can differ from only one of distance 18521 or distance 18511.

Similarly, in the present embodiment, distance 18551 of rib 1825 is different than distance 18531 of rib 1823, and different than distance 18511 of rib 1821, For example, distance 18551 is greater than distance 18531 and greater than distance 18511 in the present example, though there can be examples where distance 18551 is greater than only one of distance 18531 or distance 18511. In addition, there can be other embodiments where distance 18551 can differ from only one of distance 18531 or distance 18511. Distances 18541 and 18551 can be similar or equal to each other in the present or other embodiments.

Ribs 1820 are also aligned in the present embodiment to intersect, with respect to the top view of FIG. 18, at common point 1850 external to body 1810. In some examples, such alignment may be similar to that of ribs 34 with respect to common point 40 (FIG. 1), and/or ribs 1420 with respect to common point 1550 (FIG. 15). Although each of ribs 1820 intersects at common point 1850 in the present example, there can be other implementations where ribs 1822-1823 do not intersect at common point 1850, or where ribs 1824-1825 do not intersect at common point 1850. Common point 1850 is located forward of front surface 1416, at a distance of approximately a golf ball radius as described above with respect to common point 1550 (FIG. 15). There can be other embodiments, however, where common point 1850 can be otherwise distanced from front surface 1416, and/or where common point 1850 can be located at front surface 1416.

In the present example, ribs 1820 are aligned in a staggered pattern with respect to common point 1850, where the distances between common point 1850 and ribs 1820 vary depending on the rib. For example, rib axis 1851 of rib 1821 comprises extended distance 18512 from common point 1850 to rib end 18211, rib axis 1852 of rib 1822 comprises extended distance 18522 from common point 1850 to rib end 18221, rib axis 1853 of rib 1823 comprises extended distance 18532 from common point 1850 to rib end 18231, rib axis 1854 of rib 1824 comprises extended distance 18542 from common point 1850 to rib end 18241, and rib axis 1855 of rib 1825 comprises extended distance 18552 from common point 1850 to rib end 18251. Extended distance 18512 of rib 1821 is greater than extended distance 18522 of rib 1822, and greater than extended distance 18532 of rib 1823, thus yielding a staggered pattern. In the present embodiment, extended distance 18512 can be of approximately 44 mm, extended distance 18522 can be of approximately 33 mm, extended distance 18532 can be of approximately 33 mm, extended distance 18542 can be of approximately 51 mm, and extended distance 18552 can be of approximately 50 mm. There can also be examples where distances 18512, 18522, 18532, 18542, and/or 18552 can vary within 15% of the numbers listed above.

Figure 19:
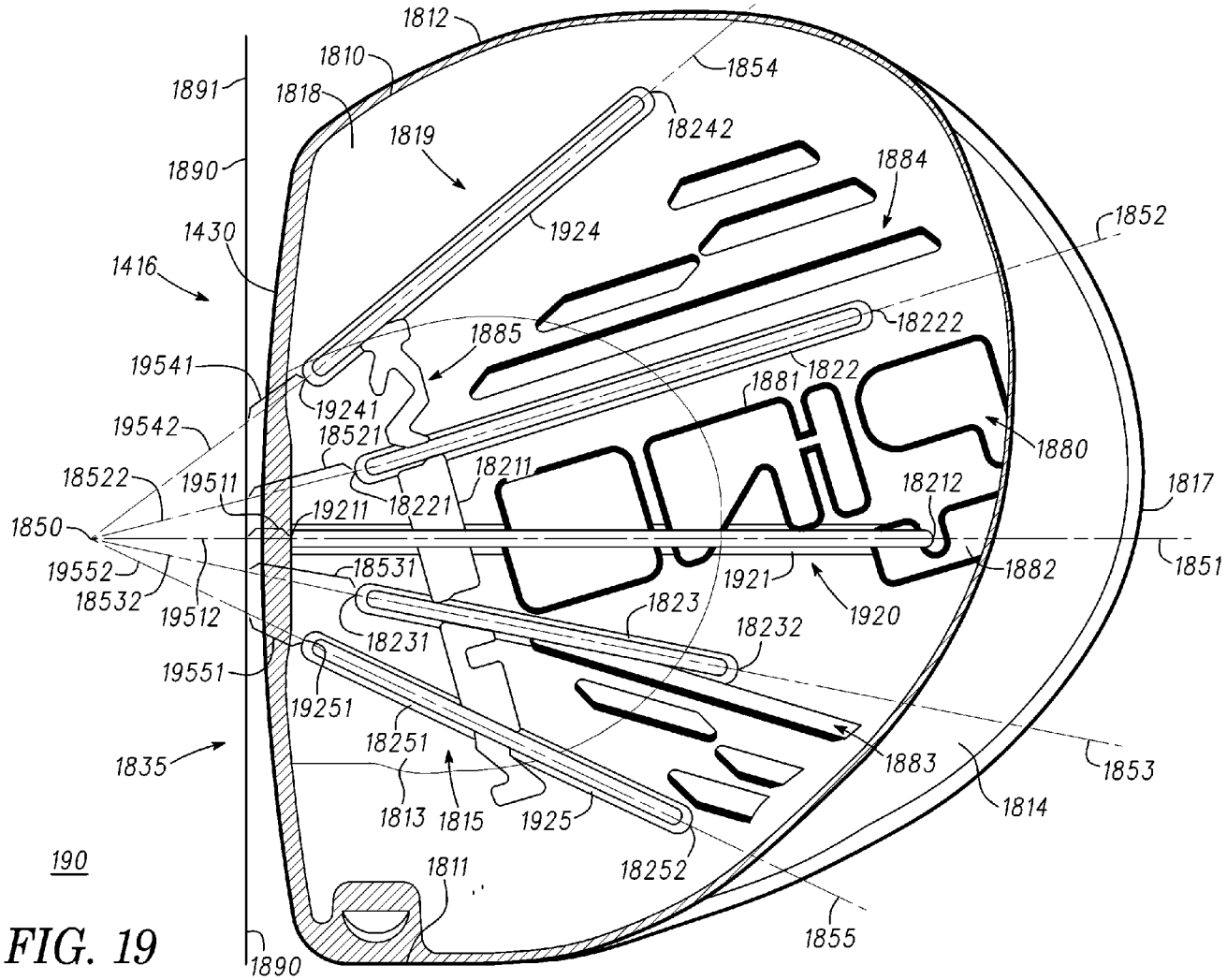
FIG. 19 illustrates a top cross-sectional view of a golf club head according to another embodiment.

FIG. 19 illustrates a top cross-sectional view of golf club head 190. Golf club head 190 is similar to golf club head 180 (FIG. 18), but comprises ribs 1920 staggered in a different pattern than ribs 1820 of golf club head 180. For example, ribs 1920 comprise ribs 1921, 1822, 1823, 1924, and 1925, where ribs 1921, 1924, and 1925 are respectively similar to ribs 1821, 1824, and 1825 of ribs 1820 (FIG. 18), but exhibit different respective rib lengths and respective distances from front plane 1890 than ribs 1821, 1824, and 1825. In particular, rib 1921 extends to front wall 1835 in the present example, such that distance 19511 between front plane 1890 and rib end 19211 of rib 1921 can be similar to the thickness of front wall 1835 at its intersection with rib 1921. Accordingly, distance 19511 of rib 1921 is less than distance 18521 of rib 1822 and less than distance 18531 of rib 1823. In other embodiments, rib 1921 does not extend all the way to front wall 1835, but can still extend closer thereto such that distance 19511 is still less than distance 18521 of rib 1822 and/or less than distance 18531 of rib 1823.

In the present implementation, rib 1921 comprises a rib length of approximately 88 mm from rib end 19211 to rib end 18212, rib 1822 comprises a rib length of approximately 70 mm from rib end 18221 to rib end 18222, rib 1823 comprises a rib length of approximately 51 mm from rib end 18231 to rib end 18232, rib 1924 comprises a rib length of approximately 53 mm from rib end 19241 to rib end 18242, and rib 1925 comprises a rib length of approximately 58 mm from rib end 19251 to rib end 18252. There can also be examples where the rib lengths of ribs 1920 can vary within 15% of the numbers listed above. In addition, each of ribs 1920 comprise substantially a rib width of approximately 3 mm, but there can be other embodiments where such the rib widths can vary within 15% of the rib width listed above, and/or where the rib widths can be non-uniform or unique.

Ribs 1924 and 1925 of ribs 1920 are closer in the present example to front plane 1890 than corresponding ribs 1824 and 1825 of ribs 1820 (FIG. 18). In view of this difference, distance 19541, which extends from front plane 1890 to rib end 19241 of rib 1924, is shorter than distance 18521 of rib 1822. Similarly, distance 19551, which extends from front plane 1890 to rib end 19251 of rib 1925, is shorter than distance 18531 of rib 1823. In the present example, distances 19541 and 19551 are substantially different from each other, but can be approximately equal to each other in other embodiments. The differences between distances 19511, 18521, 18531, 19541, and 19551 described above generate a staggered pattern for ribs 1920 that places ribs 1921, 1924, and 1925 closer to the front of golf club head 190 than ribs 1822 and 1823, where such staggered pattern is thus different than that described above with respect to ribs 1820 in FIG. 18, where ribs 1822 and 1823 are closer to the front of the golf club head than ribs 1821, and 1824, and 1825.

Consistent with the above, in the present example, distance 19511 can be of up to approximately 9 mm, distance 18521 can be of approximately 20 mm, distance 18531 can be of approximately 20 mm, distance 19541 can be of approximately 18 mm, and distance 19551 can be of approximately 10 mm. There can also be examples where distances 19511, 18521, 18531, 19541, and/or 19551 can vary within 15% of the numbers listed above. Although distances 19511, 18521, 18531, 19541, and 19551 represent distances between ribs 1920 and front plane 1890, corresponding distances between ribs 1920 and one or both of front surface 1416 or loft plane 2170 (FIG. 21) can be similar to such distances 19511, 18521, 18531, 19541, and/or 19551 in the same or other examples.

In the present example of FIG. 19, ribs 1920 are also aligned in a staggered pattern with respect to common point 1850, where the distances between common point 1850 and ribs 1920 vary depending on the rib. For example, rib axis 1851 of rib 1921 comprises extended distance 19512 from common point 1850 to rib end 19211, rib axis 1852 of rib 1822 comprises extended distance 18522 from common point 1850 to rib end 18221, rib axis 1853 of rib 1823 comprises extended distance 18532 from common point 1850 to rib end 18231, rib axis 1854 of rib 1924 comprises extended distance 19542 from common point 1850 to rib end 19241, and rib axis 1855 of rib 1925 comprises extended distance 19552 from common point 1850 to rib end 19251. Extended distances 18522 and 18532 can be greater than extended distances 19512, 19542, and 19552, thus yielding a staggered pattern with respect to common point 1850. In the present embodiment, extended distance 19512 can be of approximately 22 mm, extended distance 18522 can be of approximately 33 mm, extended distance 18532 can be of approximately 33 mm, extended distance 19542 can be of approximately 36 mm, and extended distance 19552 can be of approximately 24 mm. There can also be examples where distances 19512, 18522, 18532, 19542, and/or 19552 can vary within 15% of the numbers listed above As can be seen in FIGS. 18-19 golf club heads 180 and 190 have one or more indentation features 1880 which can be similar to indentations 1580 as described above with respect to golf club head 140 (FIGS. 14-15). Indentation features 1880 comprise indentations 1881-1885 distributed throughout different sections of sole 1813 and skirt portion 1818, where at least some of indentation features 1881-1885 can define logos or other designs to decorate and/or to strengthen or reinforce one or more sections of the portion of body 1810 where they are located. Indentations 1880 protrude into the interior of golf club head 180 in the present example, appearing embossed or corrugated from the exterior of golf club head 180, and some of them intersect with ribs 1820 along their respective rib lengths. Accordingly, portions of some ribs 1820 may be at least partially engulfed by indentation features 1880. For example, rib 1821 intersects with, and is partially engulfed by, indentation features 1881, 1882 and 1885 at sole 1813 and skirt portion 1818. Similarly, indentation feature 1885 is intersected by ribs 1822, 1823, and 1825. In addition, indentation feature 1883 is intersected by rib 1823. Not all indentation features 1880, however, need to be intersected by ribs 1820. For example indentation feature 1884 at sole 1813 and skirt portion 1818 is not in contact with any of ribs 1820, and rib 1824 does not intersect any of indentation features 1880.

As mentioned above, the embossed or corrugated configuration of indentation features 1880 can be configured to strengthen or reinforce desired sections of body 1810, such as to compensate for thinner portions thereof, to prevent material failure or deformation due to stresses at impact with a golf ball or a ground surface, and/or to adjust the sound of golf club 180 upon impact with the golf ball. In the present examples of FIGS. 18-19, sole 1813 and/or skirt portion 1818 can comprise a thickness of approximately 0.7 mm. There can be some examples where the thickness of sole 1813 and/or skirt portion 1818 can vary within 15% of the number listed above, and/or where such thickness can be non-uniform across sole 1813 and/or skirt portion 1818.

In some implementations, there may be some sections of body 1810 where it may not be desirable to place any indentation features, such as for aesthetic, design, and/or performance reasons. Such sections may thus be suitable for reinforcement via ribs 1820 rather than via indentation features 1880. As an example, rib surface 1815 comprises clear section 1819 at skirt portion 1818, where clear section 1819 is clear of any indentation features 1880 for design considerations. Nevertheless, by locating rib 1824 to protrude therefrom, clear section 1819 can still be reinforced with respect to strength or sound without having to rely on indentation features 1820. FIG. 19 also comprises indentation features 1880, which relate to sole 1813, skirt portion 1818, and ribs 1920 of golf club head 190 similar to the description above with respect to golf club head 180 in FIG. 18.

Figure 20:
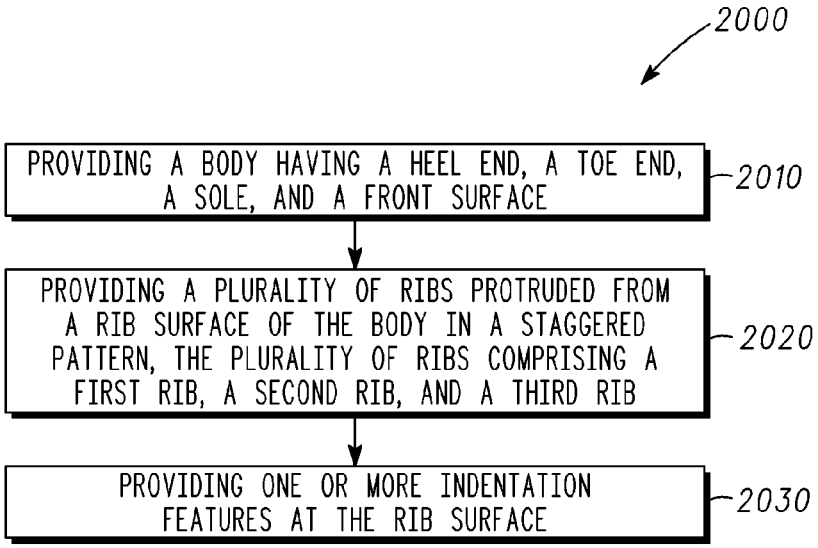
FIG. 20 illustrates a flowchart of a method for providing a golf club head in accordance with examples and embodiments of the present disclosure.

FIG. 20 illustrates a flowchart of a method 2000 for providing a golf club head. In some examples, the golf club head can be similar to one or more of the golf club heads previously described, such as golf club head 12 (FIGS. 1-3), golf club head 412 (FIGS. 4-5), golf club head 1012 (FIGS. 10-11), golf club head 1212 (FIGS. 12-13), golf club head 140 (FIGS. 14-15), golf club head 180 (FIG. 18), golf club head 190 (FIG. 19), and/or variations thereof.

Block 2010 of method 2000 comprises providing a body having a heel end, a toe end, a sole, a front surface, and a rear surface. In some examples, the body can be similar to body 1810 of golf club heads 180 (FIG. 18) or 190 (FIG. 19). The heel end, the toe end, the sole, and the front surface can be respectively similar to heel end 1811, toe end 1812, sole 1813, and front surface 1416 (FIGS. 18-19).

Block 2020 of method 2000 comprises providing a plurality of ribs protruded from a rib surface of the body in a staggered pattern. In some examples, the plurality of ribs can be similar to ribs 1820 (FIG. 18), ribs 1920 (FIG. 19), or variations thereof. The plurality of ribs can comprise first second, and third ribs, which can be similar to ribs 1821, 1822, and/or 1823 of FIG. 18, or to ribs 1921, 1822, and/or 1823 of FIG. 19. In some embodiments, the plurality of ribs can also comprise fourth and fifth ribs, which can be similar to ribs 1824 and/or 1825 of FIG. 18, or to ribs 1924 and/or 1925 of FIG. 19. Some embodiments may comprise more or less ribs, depending on the requirements of the golf club head at issue. In some examples, the staggered pattern for the ribs of method 2000 can be similar to one or more of the staggered pattern options described above with respect to ribs 1820 (FIG. 18) and/or ribs 1920 (FIG. 19).

Method 2000 can also optionally comprise block 2030 for providing one or more indentation features at the rib surface from where the plurality of ribs protrude. In some examples, the indentation features can be similar to indentation features 1880 (FIGS. 18-19) or variations thereof. Some of such indentation features may be intersected by one or more of the plurality of ribs of block 2020. In the same or other examples, the rib surface may comprise a clear section that does not have any indentation features, but that may be reinforced nevertheless by one or more of the plurality of ribs. In some examples, the clear section may be similar to clear section 1819, which is reinforced as described above with respect to FIGS. 18-19.

There can be examples where different blocks of method 2000 can be combined into a single block or performed simultaneously, and/or the sequence of such blocks can be changed. For example, blocks 2010 and 2020 may be performed simultaneously, such as by forming the plurality of ribs integrally with the rib surface, where the rib surface comprises one or more portions of one or more parts of the body of the club head. There can also be examples where method 2000 can comprise further or different blocks. As an example, method 2000 can comprise another block for providing a weight similar to sole weight 1590 (FIG. 15), where such weight can be attached to one or more of the indentation features of block 2030, and/or could engulf one or more portions of one or more of the plurality of ribs of block 2020. Other variations can be implemented for method 2000 without departing from the scope of the present disclosure.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and/or articles of manufacture described herein may be conforming or non-conforming to the rules of golf at any particular time. Accordingly, golf equipment related to the apparatus, methods, and/or articles of manufacture described herein may be advertised, offered for sale, and/or sold as conforming or non-conforming golf equipment. The apparatus, methods, and/or articles of manufacture described herein are not limited in this regard.

While at least some of the above examples have been depicted and/or described with respect to with fairway wood-type golf clubs, the apparatus, methods, and/or articles of manufacture described herein may be applicable to other types of golf clubs such as a driver-type golf club, a hybrid-type golf club, an iron-type golf club, a wedge-type golf club, and/or a putter-type golf club. Alternatively, the apparatus, methods, and/or articles of manufacture described herein may be applicable other type of sports equipment such as a hockey stick, a tennis racket, a fishing pole, a ski pole, etc.

Although certain illustrative embodiments and methods have been described herein, it will be apparent from the foregoing disclosure to those skilled in the art that variations and modifications of such embodiments and methods may be made without departing from the spirit and scope of the invention. Accordingly it is intended that the invention should be limited only to the extent required by the appended claims and the rules and principles of applicable law.

The invention claimed is:

1. A golf club head comprising:

a body having a heel end, a toe end, a sole, a crown, a front surface, and a rear surface; and a plurality of ribs protruded from a rib surface of the body and comprising:

a first rib with a first rib axis;

a second rib with a second rib axis; and a third rib with a third rib axis;

wherein:

the first, second, and third rib axes intersect at a common point located external to the body and forward the front surface; and at least one of the first, second, or third ribs are non-convex relative to the crown;

the body further comprises a skirt between the crown and the sole; and the rib surface with one or more of the first, second, and third ribs is located at least partially at the skirt.

2. The golf club head of claim 1, wherein:

each of the first, second, and third ribs is concave relative to the crown; and the rib surface is located at least partially at the sole.

3. The golf club head of claim 1, wherein:

the front surface of the body comprises a strike face with a target strike zone;

a target strike axis extends from a center of the target strike zone and substantially perpendicular to the strike face; and the common point is located along the target strike axis.

4. The golf club head of claim 1, wherein:

the front surface of the body comprises a strike face with a target strike zone; and the common point is separated from the target strike zone by a distance of approximately a golf ball radius.

5. The golf club head of claim 1, wherein:

the common point comprises an intersection locus for the first, second, and third rib axes.

6. The golf club head of claim 1, wherein:

the rib surface and the plurality of ribs are only internal to the body.

7. The golf club head of claim 1, wherein:

the rib surface with one or more of the first, second, and third ribs is located at least partially at the sole.

8. The golf club head of claim 1, wherein:

the first, second, and third ribs are non-intersected by any other ones of the plurality of ribs.

9. The golf club head of claim 1, wherein:

the body comprises a forward portion and a rearward portion;

a midline between the forward and rearward portions lies generally parallel to the front surface of the body at substantially one-half a distance between a forwardmost point at the front surface and a rearwardmost point at the rear surface;

a front end portion of each of the first, second, and third ribs lies at the forward portion; and a rear end portion of each of the first, second, and third ribs lies at the rearward portion.

10. The golf club head of claim 1, wherein:

adjacent ribs of each of the plurality of ribs diverge from each other towards the rear surface and converge towards each other towards the front surface.

11. The golf club head of claim 1, wherein:

a center of gravity of the plurality of ribs is located between a center of gravity of the golf club head and the rear surface of the body.

12. The golf club head of claim 1, further comprising:

a sole weight located at a portion of the sole;

wherein the sole weight at least partially engulfs one or more of the first, second, or third ribs.

13. The golf club head of claim 12, wherein:

a thickness of the sole weight fully engulfs a thickness of one or more portions of one or more of the first, second, or third ribs.

14. The golf club head of claim 1, further comprising:

one or more indentations at the rib surface;

wherein the one or more indentations partially engulf one or more portions of one or more of the first, second, or third ribs.

15. A golf club head comprising:

a body having a heel end, a toe end, a sole, a crown, a front surface, and a rear surface; and a plurality of ribs protruded from a rib surface of the body and comprising:

a first rib with a first rib axis;

a second rib with a second rib axis; and a third rib with a third rib axis;

wherein:

the first, second, and third rib axes intersect at a common point located external to the body and forward of the front surface;

the body further comprises a skirt between the crown and the sole; and the rib surface with one or more of the first, second, and third ribs is located at least partially at the skirt.

16. The golf club head of claim 15, wherein:

the first, second, and third ribs are non-convex relative to the crown.

17. The golf club head of claim 15, wherein:

the first and second rib axes intersect external to the body of the golf club head; and the first, second, and third ribs are non-intersected by any other ones of the plurality of ribs.

18. The golf club head of claim 15, wherein:

the common point is located forward of the front surface of the body.

19. A method comprising:

providing a body of a golf club head with:

a heel end, a toe end, a sole, a front surface, and a rear surface; and providing a plurality of ribs protruded from a rib surface of the body and comprising:

a first rib with a first rib axis;

a second rib with a second rib axis;

and a third rib with a third rib axis;

wherein providing the plurality of ribs comprises at least one of:

providing the plurality of ribs such that at least one of the first, second, or third ribs are non-convex relative to the crown; or providing the plurality of ribs such that the first, second, and third rib axes intersect at a common point located external to the body and forward of the front surface;

wherein providing the body further comprises:

providing a skirt between the crown and the sole; and providing the rib surface with one or more of the first, second, and third ribs is located at least partially at the skirt.

* * * * *